US008754576B2

(12) United States Patent
Hyde et al.

(10) Patent No.: US 8,754,576 B2
(45) Date of Patent: Jun. 17, 2014

(54) LOW PRESSURE LAMP USING NON-MERCURY MATERIALS

(71) Applicant: Elwha LLC, Bellevue, WA (US)

(72) Inventors: Roderick A. Hyde, Redmond, WA (US); Jordin T. Kare, Seattle, WA (US); Tony S. Pan, Cambridge, MA (US); Thomas Allan Weaver, San Mateo, CA (US); Lowell L. Wood, Jr., Bellevue, WA (US)

(73) Assignee: Elwha LLC, Bellevue, WA (US)

( * ) Notice: Subject to any disclaimer, the term of this patent is extended or adjusted under 35 U.S.C. 154(b) by 0 days.

(21) Appl. No.: 13/631,311

(22) Filed: Sep. 28, 2012

(65) Prior Publication Data

US 2014/0091713 A1 Apr. 3, 2014

(51) Int. Cl.
*H01J 1/62* (2006.01)

(52) U.S. Cl.
USPC ..... 313/486; 313/630

(58) Field of Classification Search
USPC ..... 313/484–486, 630
See application file for complete search history.

(56) References Cited

U.S. PATENT DOCUMENTS

| | | | | |
|---|---|---|---|---|
| 4,421,992 | A | 12/1983 | Hibbard et al. | |
| 4,492,898 | A * | 1/1985 | Lapatovich et al. | 315/248 |
| 4,617,472 | A | 10/1986 | Slavik | |
| 4,647,821 | A * | 3/1987 | Lapatovich et al. | 315/248 |
| 4,779,026 | A | 10/1988 | Heider et al. | |
| 5,589,735 | A | 12/1996 | Yamaguchi et al. | |
| 5,866,984 | A * | 2/1999 | Doughty et al. | 313/643 |
| 5,889,367 | A | 3/1999 | Hofmann et al. | |
| 6,376,982 | B1 * | 4/2002 | Bill et al. | 313/486 |
| 7,714,263 | B2 | 5/2010 | Konishi | |
| 2004/0169456 | A1 * | 9/2004 | Scholl et al. | 313/485 |
| 2008/0201595 | A1 | 8/2008 | Kawasaki | |
| 2009/0189507 | A1 * | 7/2009 | Winkler et al. | 313/484 |

* cited by examiner

*Primary Examiner* — Jason M Crawford
(74) *Attorney, Agent, or Firm* — Foley & Lardner LLP

(57) ABSTRACT

One embodiment relates to a mercury-free low-pressure lamp having a bulb. The bulb includes an emissive material and one or more phosphors. The emissive material includes at least one of an alkali metal or an alkaline earth metal, wherein when the bulb is in a non-operational state, the emissive material condenses into a liquid or solid, and when the bulb is in an operational state the emissive material forms an emitter, the emitter in combination with one or more gases generate photons when excited by an electrical discharge. The one or more phosphors are configured to convert at least a portion of the photons to other visible wavelengths.

44 Claims, 23 Drawing Sheets

LOW PRESSURE LAMP USING NON-MERCURY MATERIALS

BACKGROUND

The present application relates generally to the field of low-pressure arc discharge lamps. The present application relates more specifically to the field of mercury-free low-pressure arc discharge lamps.

Low-pressure arc discharge lamps, for example fluorescent lamps, are more efficient at generating lumens per watt than incandescent bulbs. However, mercury or a mercury amalgam is conventionally used as an emissive material because mercury emits mostly ultraviolet photons and because mercury has a high vapor pressure, making mercury easy to vaporize. However, because of the potentially toxic effects of mercury when it is released into the environment, there is a need for an improved mercury-free lamp.

SUMMARY

One embodiment relates to a mercury-free low-pressure arc discharge lamp having a bulb. The bulb includes an emissive material and one or more phosphors. The emissive material includes at least one of an alkali metal or an alkaline earth metal, wherein when the bulb is in a non-operational state, the emissive material condenses into a liquid or solid, and when the bulb is in an operational state the emissive material forms an emitter, the emitter in combination with one or more gases generate photons when excited by an electrical discharge. The one or more phosphors are configured to convert at least a portion of the photons to other visible wavelengths.

Another embodiment relates to a method of operating a mercury-free low-pressure lamp. The method includes providing a bulb having one or more phosphors configured to convert photons to visible wavelengths of light, an envelope filled with one or more gases at a low pressure, and an emissive material including at least one of an alkali metal or an alkaline earth metal. The method further includes vaporizing at least a portion of the emissive material into the envelope to form an emitter, exciting the emitter with an electron such that the emitter in combination with the gases generate visible or ultraviolet photons, and converting at least a portion of the photons to other visible wavelengths.

Another embodiment relates to an apparatus for operating a mercury-free low-pressure lamp including a bulb having: one or more phosphors configured to convert photons to visible or other visible wavelengths, an envelope filled with one or more gases at a pressure below 0.01 atmospheres, and at least one emissive material including at least one of an alkali metal and an alkaline earth metal. The apparatus includes a circuit configured, in response to a startup command, to cause the emissive material to vaporize into the envelope to form an emitter and to cause the excitation of the emitter with an electron such that the emitter in combination with the gases generate visible or ultraviolet photons.

Another embodiment relates to a method of starting a low-pressure lamp. The method includes providing a bulb having one or more phosphors configured to convert photons to visible wavelengths of light and having an envelope filled with one or more gases at a pressure below 0.01 atmospheres. The method further includes spraying at least one emissive material into the envelope, the emissive material comprising at least one of an alkali metal and an alkaline earth metal, and exciting the emissive material with an electron such that the emissive material in combination with the gases generate visible or ultraviolet photons.

The foregoing is a summary and thus by necessity contains simplifications, generalizations and omissions of detail. Consequently, those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

DETAILED DESCRIPTION

Figure 1A:
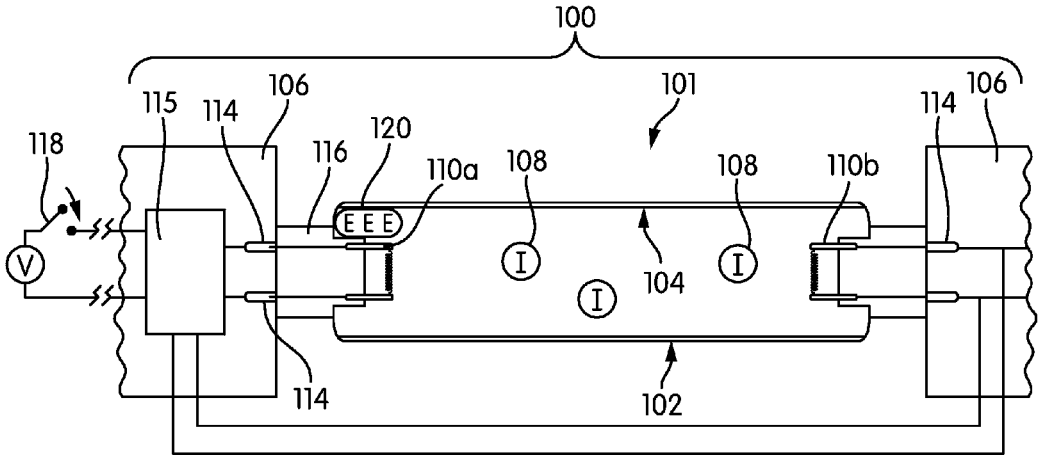
FIG. 1A is a schematic diagram of a lamp, shown according to an exemplary embodiment.

Referring generally to the Figures, a lamp and components thereof are shown according to exemplary embodiments. The lamp may be a low-pressure arc discharge lamp, for example a fluorescent lamp, and may range in size from a compact fluorescent lamp (CFL) to a high-output parking lot or stadium sized lamp. The lamp includes a bulb, which may have an end plug and may be supported by a fixture. The bulb includes an envelope configured to receive and contain an ionizable gas. The lamp may be an electrodeless lamp or may include electrodes configured to create an arc which ionizes said gas. An emissive material is vaporized and dispersed in the envelope to form one or more emitters (i.e., atoms of the vaporized emissive material), which are excited by free electrons. An excited emitter gives off a photon as an electron in the emitter returns to a lower energy state from an excited, higher energy state. The photon given off by the emitter is converted by phosphors in the bulb from an invisible or less desirable wavelength to a visible or more desirable wavelength.

Conventionally, mercury or a mercury amalgam is used as an emissive material because mercury vapor emits mostly ultraviolet photons and because mercury has a high vapor pressure, making mercury easy to vaporize into the envelope. Mercury's vapor pressure is sufficiently high that the heat from ionizing the inert gas causes the mercury to vaporize.

Non-mercury emissive materials tend to have lower vapor pressures than mercury and, thus, may need assistance in order vaporize, especially in the short time spans that users expect a lamp to start and reach peak lumen output. According to one embodiment, a heater is used to vaporize the emissive material. According to another embodiment, a cooler is used to condense the emissive material in a selected portion of the lamp, for example, proximate the heater. According to various embodiments, the lamp may include a circuit configured to control the activation and deactivation of the heater and cooler. According to yet other embodiments, an injector may be used to spray the emissive material into the envelope. As the systems and methods described herein may require additional power during startup, systems and methods for controlling the startup of a plurality of lamps to reduce current or power spikes are also described.

Before discussing further details of the lamps and/or the components thereof, it should be noted that for purposes of this disclosure, the term coupled means the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

Figure 1B:
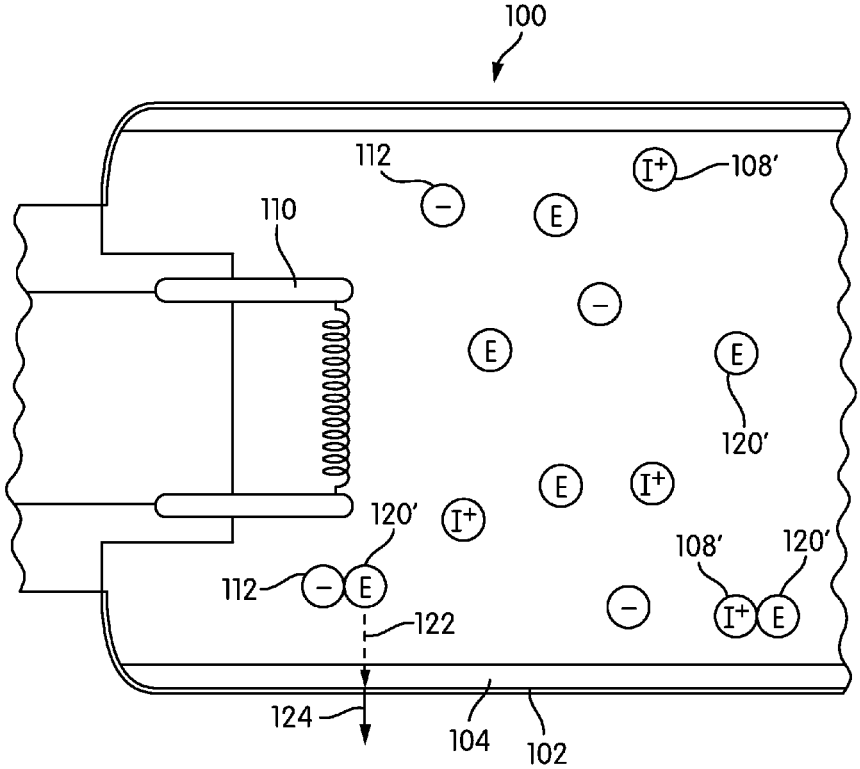
FIG. 1B is a schematic diagram of a portion of the lamp of FIG. 1A, shown according to an exemplary embodiment.

Referring to FIGS. 1A and 1B, a lamp 100 (e.g., low-pressure lamp, a low-pressure arc discharge lamp, fluorescent lamp, etc.) is shown according to an exemplary embodiment. The lamp 100 includes a bulb 101 (e.g., tube, housing, luminary, etc.), which includes an envelope 102 (e.g., tube, container, etc.) and an emissive material 120. An inert gas 108 (e.g., noble gas, neon, argon, krypton, xenon, etc.) is sealed inside the envelope 102 during manufacture of the bulb 101. The envelope 102 is sealed such that the inert gas 108 is maintained at a low pressure (e.g., less that 1% of atmospheric pressure, approximately 0.3% of atmospheric pressure, etc.). Other gases may be used; however, using noble gases (e.g., inert gases) simplifies the chemistry of ionization and eliminates the need for energy that would otherwise be required to split a molecule during ionization.

As shown, the envelope 102 is lined with one or more phosphors 104 that are configured to receive photons of visible and invisible (e.g., ultraviolet light) light and emit photons of visible light. For example, the phosphors 104 may be configured to convert photons from one wavelength to another visible wavelength. Further, the phosphors may be configured to provide specific wavelengths, for example to provide a desired color, or a plurality of visible wavelengths in order to produce a whiter light.

Figure 2A:
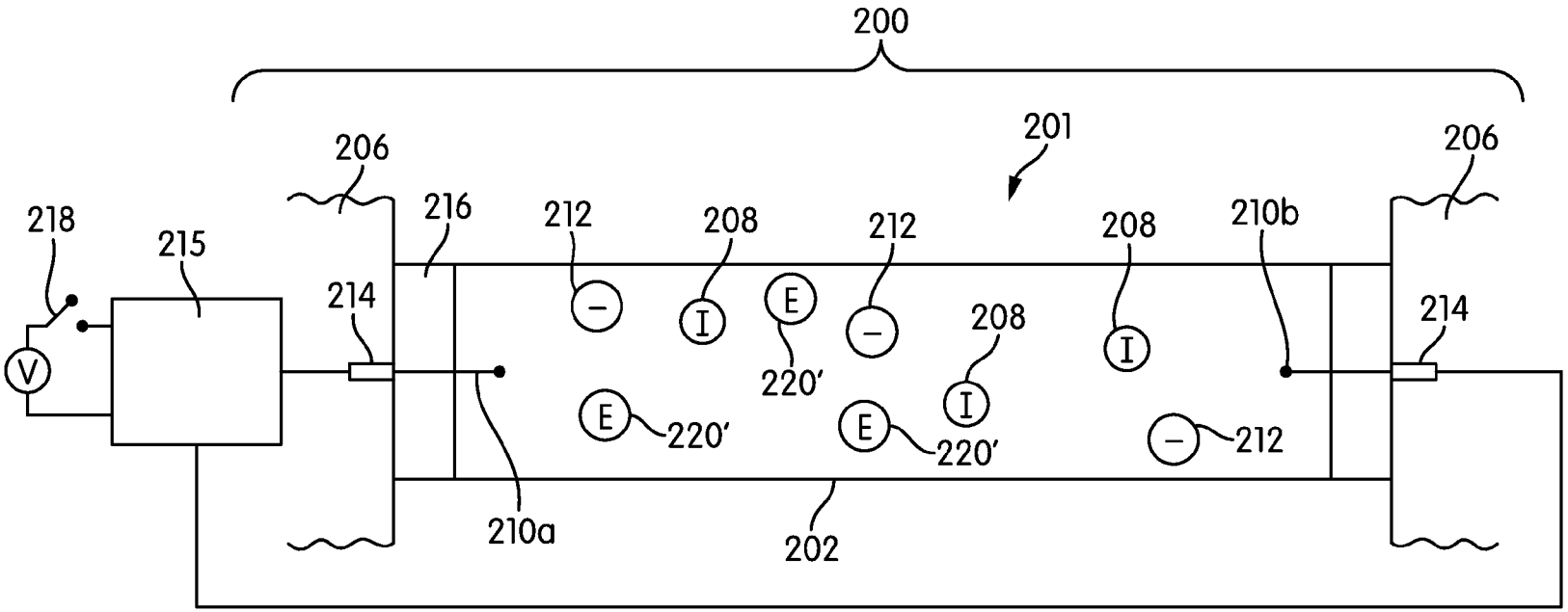
FIG. 2A is a schematic diagram of a lamp, shown according to another embodiment.
Figure 2B:
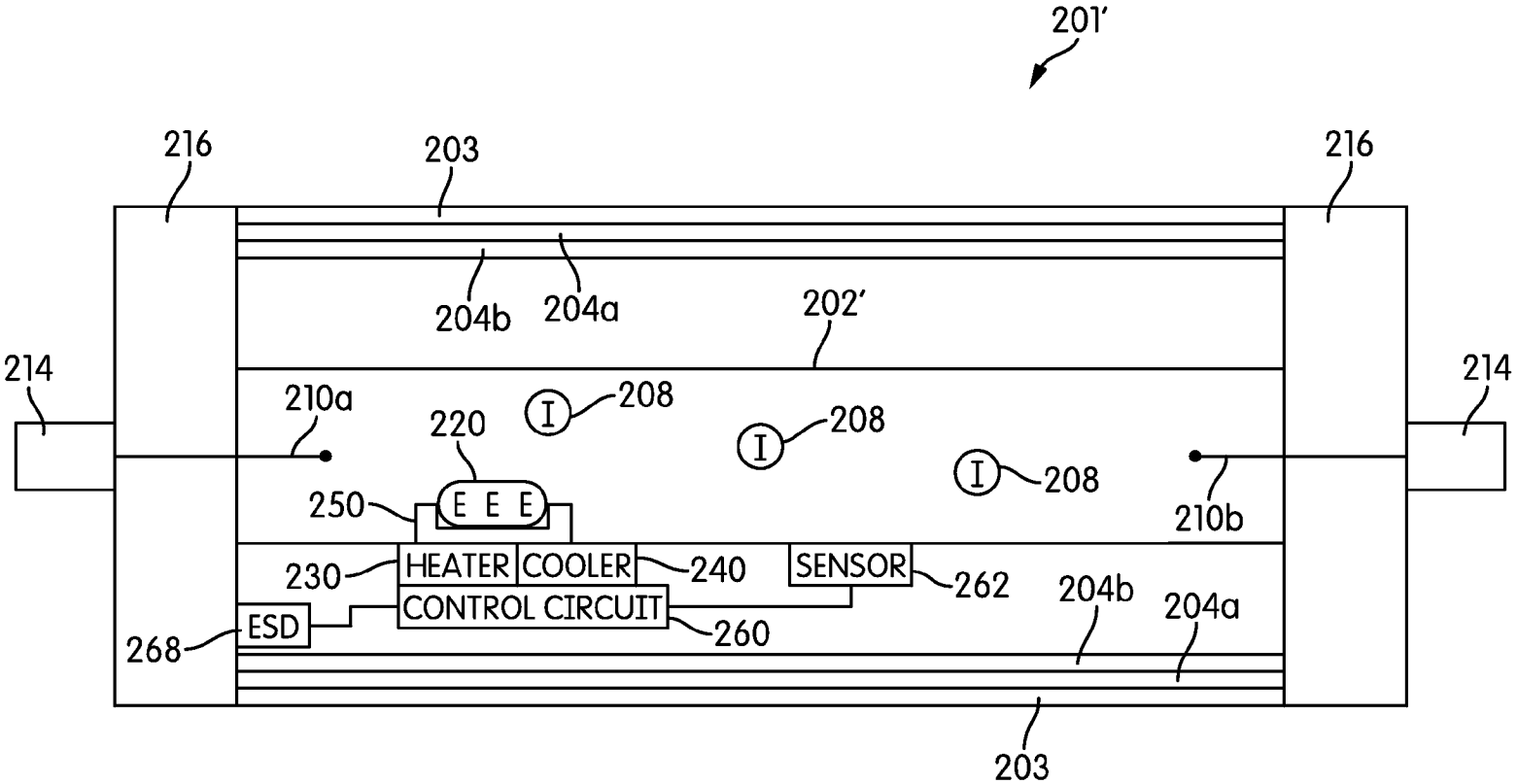
FIG. 2B is a schematic diagram of a lamp, shown according to another embodiment.

Referring to FIG. 2A, it is contemplated that in some embodiments, the bulb 101 may not include any phosphors, for example, in a germicidal lamp in which ultraviolet wavelengths are preferred. Referring to FIG. 2B, it is further contemplated that the bulb 201 may include more than one layer of phosphors, shown as first layer of phosphor 204*a* and second layer of phosphor 204*b*. Having multiple layers of phosphor may facilitate sequential deposition of phosphors having different wavelength conversion properties. Having multiple layers may also enable the use of one or more intermediate phosphors which convert the plasma radiation wavelengths to an intermediate wavelength, which in turn is converted to an output wavelength by an outer layer of phosphors.

Referring to FIG. 2B, the bulb 201' may include a first or inner envelope 202' configured to contain the emissive material 220, the inert gas 208, and the arc-discharge. The bulb 201' may further include a second or outer envelope 203 (e.g., tube, housing, container, etc.) configured to support the phosphors 204. According to the embodiment shown, the first envelope 202' extends within the second envelope 203. According to another embodiment, the first envelope 202' may be adjacent to the second envelope 203. The inner envelope 202' maintains a relatively high temperature, for example, with respect to the outer envelope 203. The space between the inner envelope 202' and the outer envelope 203 may be substantially evacuated, filled with an inert gas, incorporate baffles, or be filled with a substantially transparent and/or translucent material (e.g., aerogel) to control convective heat transfer from the inner envelope 202' to the outer envelope 203.

Returning to FIGS. 1A and 1B, the bulb 101 and envelope 102 may be formed of a material that is substantially translucent or substantially transparent to visible light, for example, glass, quartz, ceramic, etc. The envelope 102 is shown to be an elongated tube supported at opposite ends by one or more fixtures 106. According to other embodiments, the bulb 101 and the envelope 102 may be bent in a circular shape, a U-shape, a spiral shape, or any other shape. The bulb 101 or envelope 102 may also take a form other than a simple tube, such as two or more tubes joined together. Depending on the shape of the bulb 101, both ends of the bulb 101 may be supported by a single fixture 106. According to various embodiments, the fixture 106 may be portable (e.g., a flashlight, torch, table lamp, etc.) or the fixture may be substantially stationary (e.g., a chandelier, a sconce, a streetlamp, etc.). According to some embodiments, the fixture 106 may be a part of the lamp 100, and the bulb 101 may be releasably coupled to the fixture 106.

Electrodes 110, shown as first electrode 110*a* and second electrode 110*b*, create an arc that ionizes a portion of the inert gas 108 into ions 108' and electrons 112. The power or energy used to create the arc is received from one or more contacts 114, which are shown as pins or bayonets. According to other embodiments, the contacts 114 may be prongs, flexible leads, screw-type contacts, or any other suitable electrical connector. The fixture 106 is configured to provide electrical power to contacts 114.

Electrical power flowing to the lamp passes through a ballast 115. As shown, the ballast 115 is located in the fixture 106. According to another embodiment, the ballast 115 may be attached directly to the bulb 101, for example, located in an end plug 116 between the contacts 114 and the electrode 110.

In traditional fluorescent lamp installations, the ballast 115 comprises a simple inductor or resistor, and performs the single function of limiting the alternating current flowing through the lamp. A starter switch (not shown) may be included in series between the electrodes 110*a*, 110*b*, and open in phase with the ballast to send an inductive voltage spike between the electrodes 110*a*, 110*b* to create the arc and start the bulb 101. However, more generally, the ballast may contain passive or active electrical components (e.g., transformer, autotransformer, solid-state inverter circuit) to convert the input voltage, frequency, and waveform to a different voltage, frequency, or waveform which is applied to the lamp electrodes 110. For example, the ballast 115 may be configured to heat the electrodes 110*a*, 110*b* to create a glow discharge which propagates through the bulb 101 to initiate the arc discharge and start the bulb 101. Briefly referring to FIGS. 2A and 2B, in some embodiments the electrodes 210 may each only have a single contact 214. In these embodiments, the ballast 215 simply creates a high enough voltage between the electrodes 210*a*, 210*b* that the gas in the envelope 202, 202' breaks down and an arc discharges therebetween. In other embodiments, the ballast may convert the supplied power into radiofrequency (RF) power which is coupled into the plasma via capacitive, inductive, or RF absorption processes; in such embodiments electrodes 110 may take the form of capacitive plates, one or more inductive coils, or one or more RF antennas. In such embodiments electrodes 110 may be located entirely external to envelope 202.

The switch 118 may be provided to switch or "turn" the lamp 100 on and off. The switch may be a manually operated switch or a remote control switch (e.g., operated by a computer system, an automatic controller, etc.), and the switch may be located on the lamp 100, proximate the lamp 100, or remote from the lamp 100. According to the exemplary embodiment shown, the lamp 100 or a control circuit configured to start the lamp 100 is configured to receive a startup command, for example, from the switch 118 or a computer system. The control circuit may be configured to recognize a change in a power state as a startup command. The lamp 100 or a control circuit configured (e.g., the control circuit configured to start the lamp 100, a control circuit configured to shut down the lamp 100, etc.) may be configured to received a shutdown command, for example, from the switch 118 or a remote controller. A remote control switch may be configured to operate in response to a signal (e.g., ultrasonic, RF, infrared, digital network, etc.) from a remote controller.

When the bulb 101 is in a non-operational state, as shown, for example, in FIG. 1A, the emissive material 120 is largely in, or may condense into, a liquid or solid state. When the bulb 101 is in an operational state, as shown, for example, in FIG. 1B, the condensed emissive material 120 is converted to emitters 120'. In some embodiments, this conversion may be a simple state change (i.e., evaporation) of an elemental emissive material 120. In some embodiments, the emissive material 120 may be a mixture or amalgam of two or more materials, one or more of which may be evaporated to form emitters 120'. In some embodiments, the emissive material 120 may be a chemical compound which is thermally dissociated into emitters 120' and non-emitting atoms or molecules. In some embodiments, the conversion may be facilitated by mechanical dispersion (e.g., spraying, injection, etc.) of the emissive material 120 within the envelope 102. One or more free electrons 112 excite the emitter 120', causing the emitter to emit or release a photon 122, which may be of a visible or invisible wavelength (e.g., ultraviolet). The photon 122, in turn, excites one of the phosphors 104, which emits a photon 124 having a wavelength in the visible spectrum.

According to various exemplary embodiments, the emissive material 120 includes an alkali metal (e.g., lithium, sodium, potassium, rubidium, etc.). According to various embodiments, the emissive material 120 may be a mixture or alloy of atoms. According to one exemplary embodiment, the emissive material is sodium-potassium (NaK). According to another exemplary embodiment, the emissive material 120 is disodium-potassium ($Na_2K$). According to various other embodiments, the emissive material 120 includes an alkaline earth metal (e.g., beryllium, magnesium, calcium, strontium, etc.). Non-mercury emissive materials tend to have lower vapor pressures than mercury and, thus, may need assistance in order to vaporize sufficiently. Systems and methods for dispersing non-mercury emissive materials 120 into the envelope 102 are described below. These systems and methods may also be used for dispersing mercury into the envelope.

Figure 3:
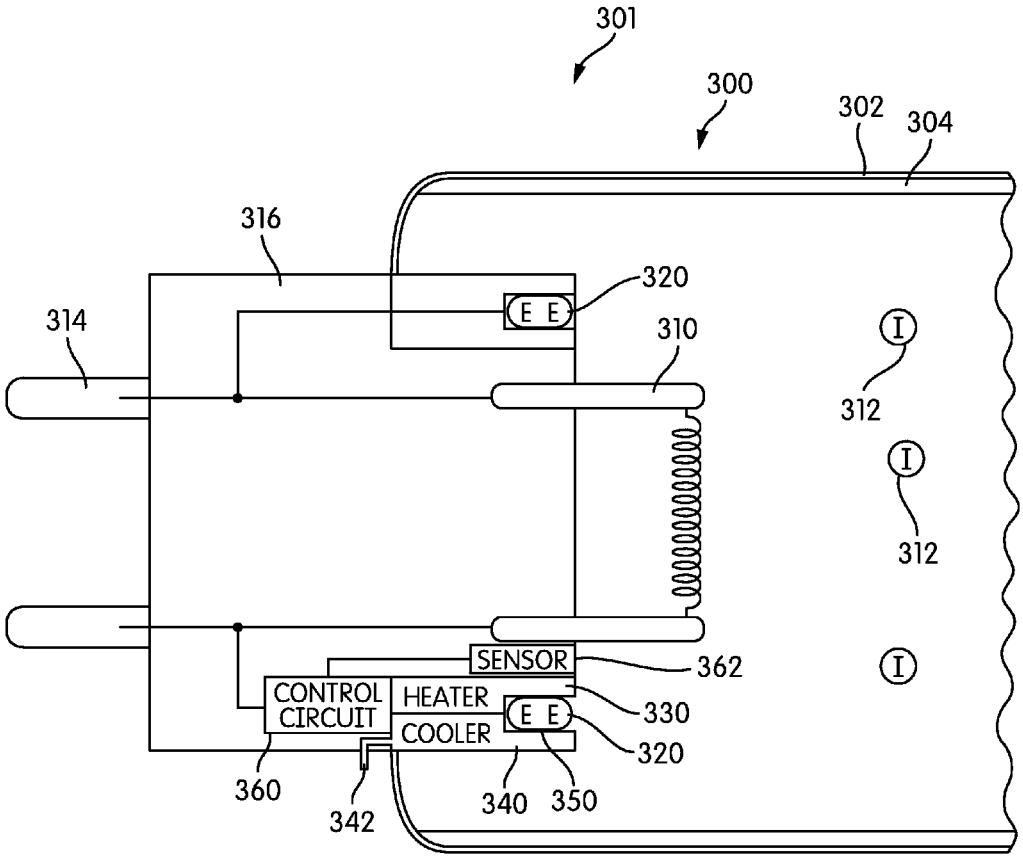
FIG. 3 is a schematic diagram of a portion of a lamp, shown according to another embodiment.

Referring to a FIG. 3, a lamp 300 is shown according to an exemplary embodiment. The lamp 300 includes an envelope 302 lined with a layer of phosphors 304. Electrodes 310 are configured to receive power from contacts 314 and to create an arc which ionizes the inert gas 312. The lamp 300 is further shown to include a reservoir 350 and a thermal controller, which may include a heater 330 and/or a cooler 340.

The heater 330 is configured to provide energy (e.g., heat, etc.) to the emissive material 320. According to the embodiment shown, the heater 330 is configured to raise the temperature of the emissive material 320 in the reservoir 350 such that the vapor pressure of the emissive material 320 is increased such that the emissive material 320 begins to vaporize. For example, the heater 330 may be configured to raise the vapor pressure of the emissive material 320 above the pressure inside the envelope 302. According to various embodiments, the heater 330 is configured to raise the temperature of the first portion of the lamp above 50 degrees centigrade and is configured to at least partially vaporize the emissive material 320 within a startup time of the heater 330 receiving power. According to another embodiment, the heater 330 is configured to completely vaporize the emissive material 320 within a startup time of the heater 330 receiving power. The startup time may be sufficiently short such that there is no perceptible delay (e.g., less than 1 second, less than 0.5 seconds, less than 0.3 seconds) in starting the lamp 300. According to one embodiment, the startup time may be less than 5 seconds. The startup time of the apparatuses, systems, and methods described herein may be substantially faster than the startup times of conventional sodium vapor lamps, which may take 30 seconds to start to arc. According to other embodiments, the heater 330 may be configured to raise the vapor pressure of the emissive material 320 above a threshold pressure for maintaining a discharge, and the heater 330 may be configured to attain the threshold pressure within a startup time of the heater 330 receiving power. According to another embodiment, the heater 330 is configured to raise the temperature of the emissive material 320 to at least the boiling point of the emissive material. The heater 330 may be configured to heat the emissive material using a resistive element, electromagnetic induction, electromagnetic radiation (e.g., radio frequency, microwaves, millimeter, infrared, visible light, etc.), ultrasound, or resistive self-heating. As shown in FIG. 3, the heater 330 is coupled to or is incorporated into the lamp 300, for example, in the bulb 301, and more specifically in the end plug 316. According to various embodiments, the heater may be located in a position other than the end plug. For example, referring briefly to FIG. 2B, the heater 230 may be coupled to or incorporated into the envelope 203; or, referring briefly to FIG. 4, the heater 430 may be coupled to or be incorporated into the fixture 416 that supports the lamp 400.

The lamp 300 is further shown to include a control circuit 360. The control circuit 360 may include any number of mechanical or electrical circuitry components or modules for controlling the heater 330 or the cooler 340. For example, the control circuit 360 may include a switch, a capacitor, an inductor, a resistor, or other solid state circuitry components. According to another embodiment, the control circuit 360 may include a processor. The processor may be or include one or more microprocessors, an application specific integrated circuit (ASIC), a circuit containing one or more processing components, a group of distributed processing components, circuitry for supporting a microprocessor, or other hardware configured for processing. According to an exemplary embodiment, the processor is configured to execute computer code stored in a memory to complete and facilitate the activities described herein. The memory can be any volatile or non-volatile memory device capable of storing data or computer code relating to the activities described herein. For example, the memory may include modules that are computer code modules (e.g., executable code, object code, source code, script code, machine code, etc.) configured for execution by the processor. When the code modules are executed by the processor, the control circuit is configured to complete the activities described herein.

The control circuit 360 may be configured to control the heater 330 in response to an input. For example, the control circuit 360 may be configured to switch off the heater 330 in response to an input. According to one embodiment, the control circuit 360 controls the heater 330 in response to a profile in time. For example, the circuit 360 may include a timer circuit which switches off the heater 330 a fixed amount of time after power is applied to the lamp 300. According to another embodiment, the control circuit 360 switches off the heater 330 in response to an electrical state or property of the lamp 300. For example, the circuit 360 may detect a voltage or a current, or the circuit 360 may detect that a shutdown command. The circuit 360 may detect whether electrode 310 has established an arc and has ionized the inert gas 312.

As shown, the lamp 300 includes a sensor 362 which may receive the input and provide the input to the control circuit 360. The sensor 362 is illustrated as separate from the control circuit 360, but in other embodiments, the sensor 362 may be part of the control circuit 360. According to one embodiment, the control circuit 360 switches off the heater 330 in response to a temperature of the lamp 300 or a portion thereof, for example, the bulb 301, the envelope 302, the inert gas 312, or a portion of the end plug 316. For example, the sensor 362 may include a thermostat, a thermistor, a thermocouple, etc., and the circuit 360 may use the sensor 362 to detect the temperature of the lamp 300 or a portion thereof. According to another embodiment, the control circuit 360 switches off the heater in response to an optical output of the bulb 301. According to various embodiments, the optical output of the bulb 301 may be a total output, a brightness at a first location, an irradiance, or a spectral irradiance. For example, the sensor 362 may include a photodiode, phototransistor, or other light-sensitive device, and the circuit 360 may use the sensor to detect the light output of the bulb 301.

Figure 4:
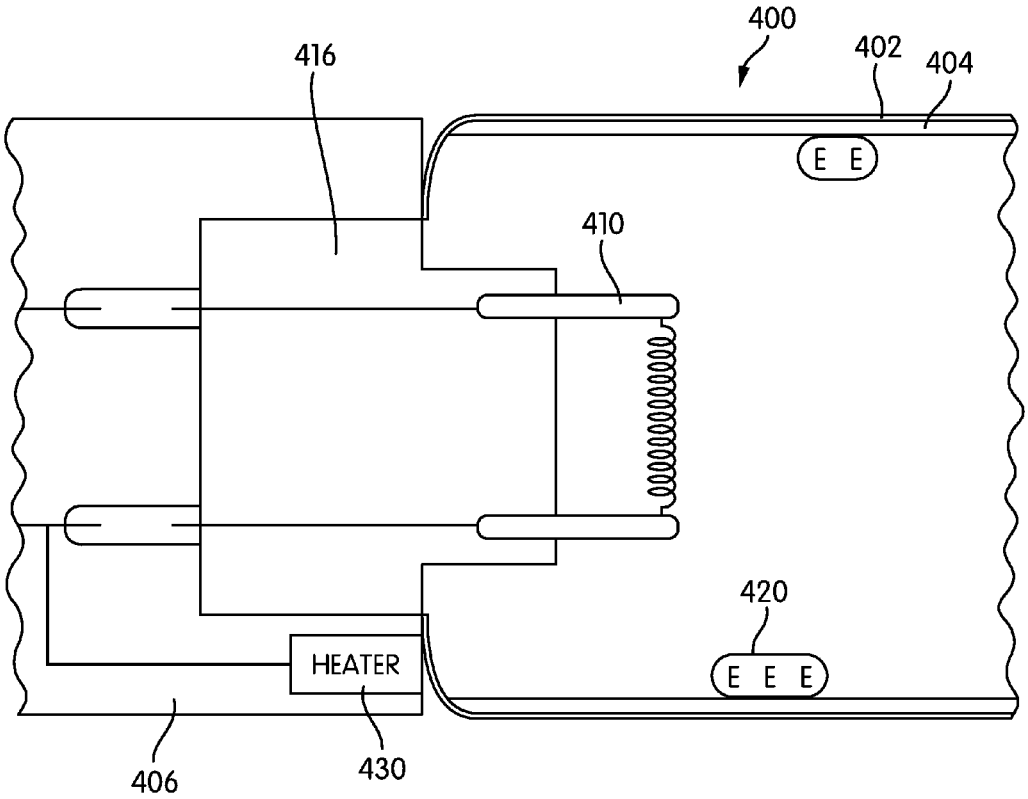
FIG. 4 is a schematic diagram of a portion of a lamp, shown according to another embodiment.

When the lamp 300, 400 is switched off and allowed to cool, the emissive material 320, 420 may condense, returning to a liquid or solid state. That is, the emitter may form (e.g., transform into, become, condense into, etc.) a liquid or sold state of the emissive material 320. Condensation generally occurs at the coolest part of the lamp 300, 400. As shown in FIG. 4, the emissive material 420 condenses along the envelope 402. Accordingly, the heater 430 may be configured to heat at least a portion of the envelope 402 in order to vaporize the emissive material 420. According to one embodiment, the heater 430 is configured to heat the entire envelope 402.

Returning to FIG. 3, the lamp 300 is configured such that the emissive material 320 preferably condenses in the reservoir 350. That is, the reservoir 350 is configured to induce condensation of the emissive material 320 therein. Accordingly, the heater 330 can focus the heating energy on a more concentrated portion of the lamp, thereby reducing the energy required and the time necessary to vaporize the emissive material 320. The reservoir 350 may be of any suitable shape, for example, the reservoir 350 may be a recess, a depression, or a substantially flat surface. The reservoirs 350 are illustrated as being located on the end plug 316 outboard of the electrodes 310. According to other exemplary embodiments, the reservoirs 350 may be located elsewhere on the lamp 300, for example, along the envelope 302. According to another exemplary embodiment, the reservoir 350 may be located substantially between the electrodes 310 and thus able to take advantage of the electricity and heat of the electrodes 310 to vaporize the emissive material 320 during startup.

Figure 5:
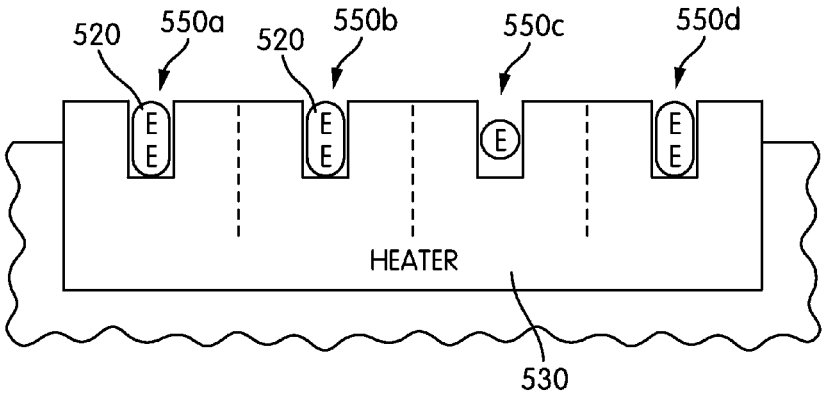
FIG. 5 is a schematic diagram of a portion of a lamp, shown according to another embodiment.

As shown, the reservoir 350 is configured to receive the emissive material 320, and the heater 330 is configured to heat at least one of the reservoirs 350 and the emissive material 320 therein. Referring to FIG. 5, the lamp may include a plurality of reservoirs 550, shown as first through fourth reservoirs 550*a*-550*d*, and the heater 530 may be configured to heat the emissive material 520 in the reservoirs 550 sequentially, simultaneously, or any combination thereof. Heating the reservoirs sequentially reduces the peak energy (e.g., current draw) required to vaporize the emissive material 520; whereas, heating the reservoirs simultaneously may help the lamp achieve peak lumen output in a shorter period of time.

The cooler is configured to remove energy from the emissive material 320. The cooler 340 is configured to reduce the temperature of at least a portion of the lamp 300 (e.g., a cold spot, etc.) such that the emissive material 320 preferentially condenses at the cold spot. For example, the cooler 340 may be used to induce condensation of the emissive material 320 in the reservoir 350. The portion cooled by the cooler 340 may be the same portion or approximately the same portion (i.e., proximate to) the portion of the lamp heated by the heater 330. Accordingly, the cooler 340 induces condensation of the emissive material 320 proximate the heater 330, thereby preparing the lamp 300 to more efficiently startup in response to the next startup command. According to another embodiment, the cooler induce condensation of the emissive material at a portion of the lamp 300 remote from the reservoir 350. The lamp may then be configured such that the emissive material 320 that is in a liquid state at the cold spot flows to the reservoir 350.

According to one embodiment, the cooler 340 reduces the temperature of the cold spot via passive cooling. For example, the cooler 340 may cool by radiating heat to the environment, by convecting heat to the environment, or by conducting heat to another location (e.g., another portion of the lamp, to the environment, etc.). As shown, the cooler 340 includes a fin 342 which is configured to increase the heat flux from the reservoir 350 to the environment around the lamp 300. According to one embodiment, the cooler 340 may include a heat pipe.

According to another embodiment the cooler 340 reduces the temperature of the cold spot via active cooling. For example, the cooler 340 may cool by forcing a fluid (e.g., air, a liquid, etc.) over the cold spot or by forcing a fluid over another portion thermally coupled to the cold spot. The cooler 340 may be powered by a power supply external to the lamp 300. For example, the cooler may be coupled to mains electricity and may be configured to receive power even when the lamp is switched off. For example, the control circuit 360 may be configured to provide power to the cooler even after power is removed from electrode 310 and the bulb 301 is in a non-operational state.

Figure 6:
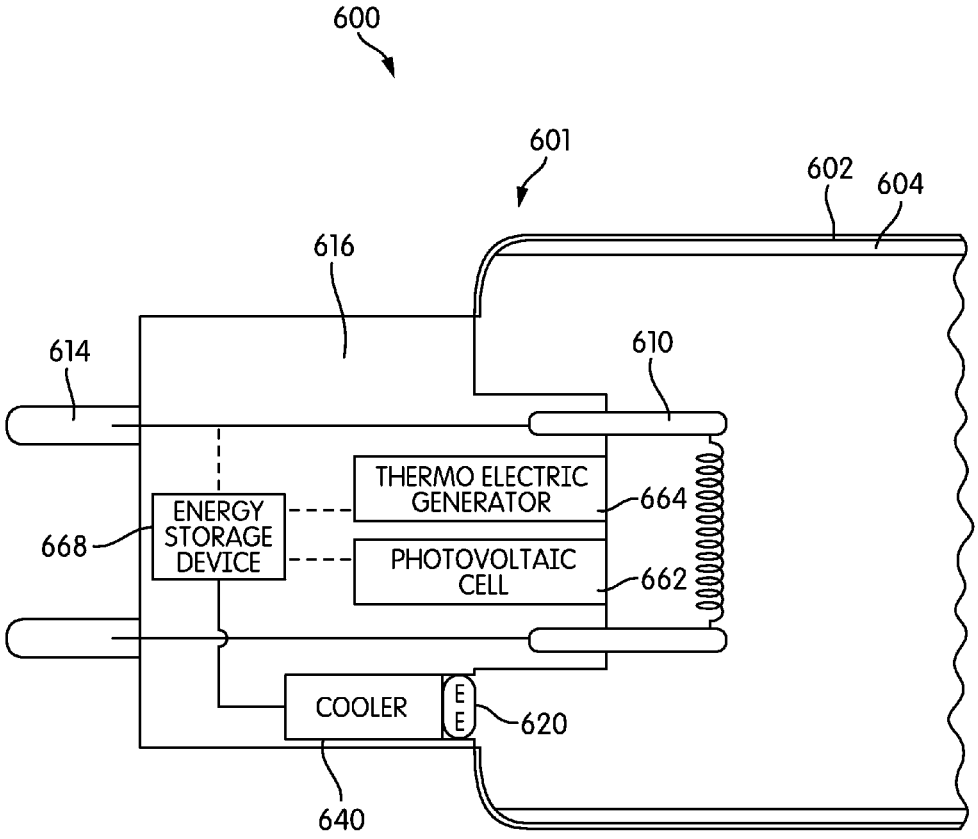
FIG. 6 is a schematic diagram of a portion of a lamp, shown according to another embodiment.
Figure 11:
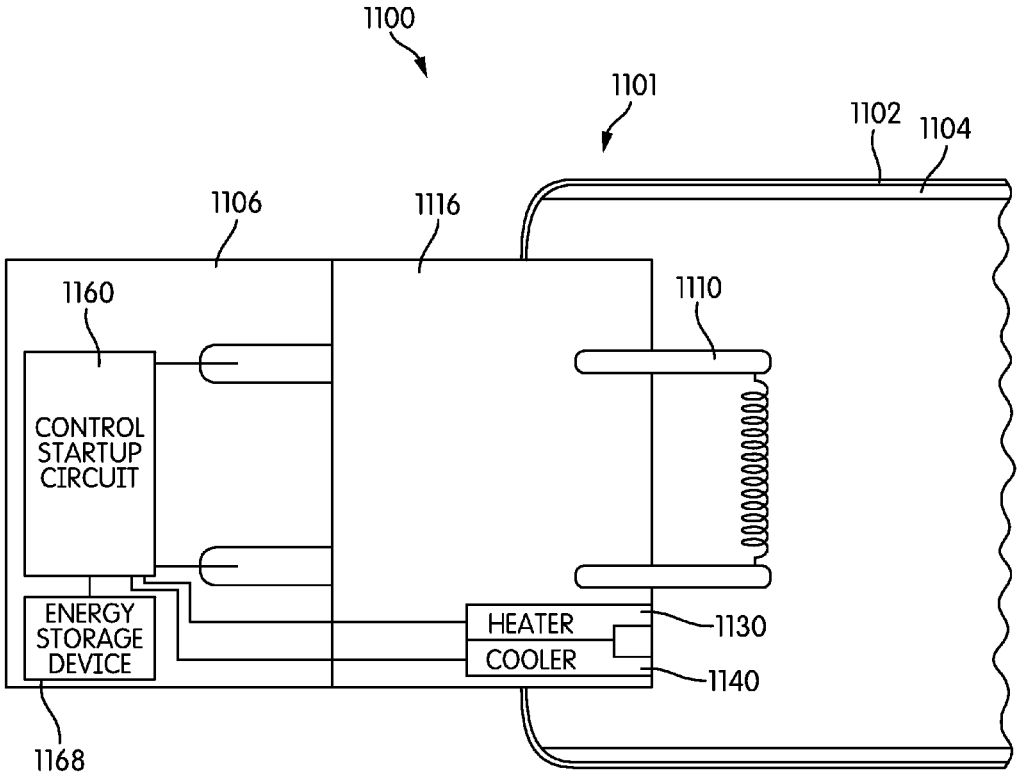
FIG. 11 is a schematic diagram of a portion of a lamp, shown according to another embodiment.

The cooler may be powered by an energy storage device (e.g., power source, etc.) coupled to the lamp. Referring briefly to FIG. 11, the energy storage device 1168 may be located in a fixture 1106 configured to support the bulb 1101. Referring to FIG. 6, the energy storage device 668 may be located in the end plug 616 of the lamp 600. According to various embodiments, the energy storage device 668 may be a battery or a capacitor. The energy storage device 668 may be charged while the lamp 600 is switched on. For example, the energy storage device 668 may be charged by a thermoelectric generator 664 which generates energy from heat from the bulb 601. The energy storage device 668 may be charged by a photovoltaic cell 662 (e.g., solar cell) which generates energy from the light from the bulb 601. The energy storage device 668 may be charged be electricity from a power supply external to the lamp 600. For example, the energy storage device may be coupled to mains electricity through pins 614.

Figure 27:
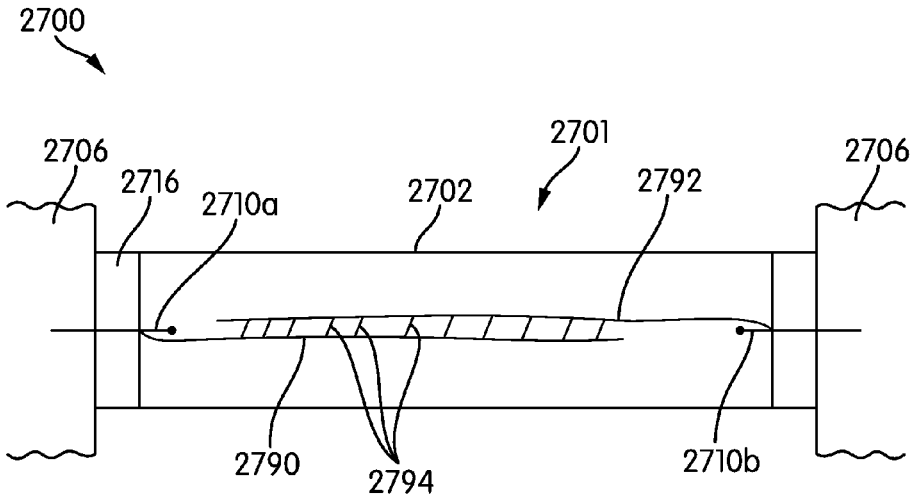
FIG. 27 is a schematic diagram of a lamp, shown according to another embodiment.
Figure 28:
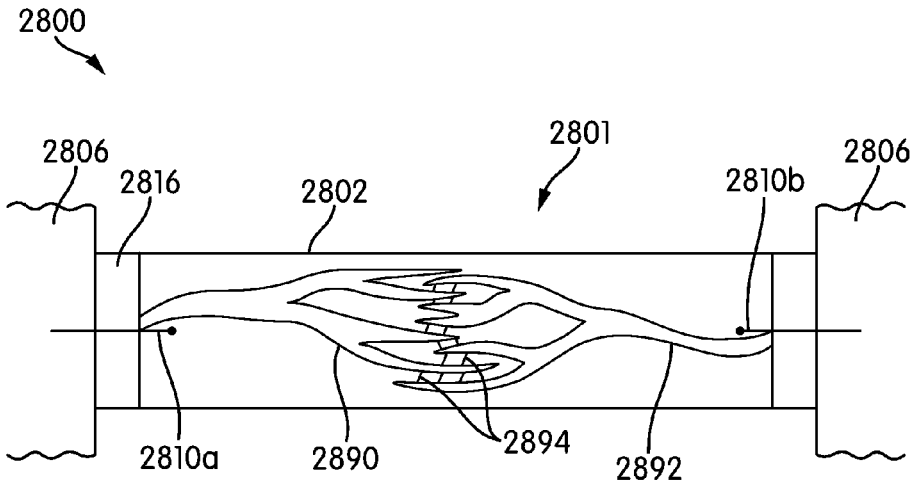
FIG. 28 is a schematic diagram of a lamp, shown according to another embodiment.

Referring to the embodiments of FIGS. 27 and 28, shown schematically, in some embodiments, the reservoir may have the form of a pattern or network distributed over a portion of the inner surface of the envelope. According to some embodiments, at least a portion of the pattern or network includes microchannels etched or printed onto the inner surface of the envelope 2702, 2802 of the bulb 2701, 2702. According to other embodiments, at least a portion of the pattern or network includes a material (e.g., a wick, a tapered-pitch fabric wick, etc.) wetted by the emissive material, such that the condensing emissive material will be distributed over the pattern by capillary force. The pattern or network may comprise a resistive heater. The pattern or network may comprise paths which act as resistive self-heaters when coated with emissive material.

As shown in FIG. 27, the lamp 2700 includes a first conductor 2790 extending from the first electrode 2710*a*, and a second conductor 2792 extending from the second electrode 2710*b*. At least one path 2794 (e.g., channels, filaments, etc.) extends between the first and second conductors 2790, 2792, forming a portion of a current path between the electrodes 2710*a*, 2710*b*. The paths 2794 are configured to preferentially induce condensation of the emissive material therein or thereon. For example, the paths 2794 may include a chrome filament, the paths 2794 may be passively cooled (e.g., coupled to a radiative element), or the paths 2794 may be actively cooled. Accordingly, when the lamp 2700 is in a non-operational state, the emissive material condenses into or onto the paths 2794. During startup, current passes between the first conductor 2790 and the second conductor 2792 via the paths 2794, the current passing through the emissive material and causing vaporization thereof.

As shown in FIG. 28, the first and second conductors 2892 may form more intricate networks where some portions of the conductors 2890, 2892 or paths 2894 have different cross-sections of their lengths. For example the networks may have the appearance of filigree or an arterial tree. In such an embodiment, the paths 2894 extend between the first and second conductors 2890, 2892 like capillaries. According to another embodiment, the elements 2890, 2892 are not conductors, instead being thickening channels such that as the emissive material condenses proximate the paths 2894, the condensed material flows away from the paths 2894. The emissive material may itself be the conductor, forming at least part of the conductive path.

Referring to the embodiments of FIGS. 23-26, shown schematically, it is contemplated that the components of the lamp 2300, 2400, 2500, 2600 may be assembled in a variety of different configurations. For example, the lamp 2300 includes a bulb 2301 supported by a fixture 2306. The thermal controller 2331, which is shown to include the heater 2330 and cooler 2340, is located in the bulb 2301 along with the control circuit 2360. For example, the thermal controller 2331 and the control circuit 2360 may be located between a plurality of envelopes.

Lamp 2400 includes a bulb 2401 having an end plug 2416, the bulb 2401 supported by the fixture 2406. The reservoir 2450 is located in the envelope 2402, which is located in the bulb 2401. The thermal controller 2431, shown to include the heater 2430 and cooler 2440 are located in the end plug 2416, along with the sensor 2462, control circuit 2460 and energy storage device 2468. In such an embodiment, a bulb 2401 having the improvements described herein may be installed (e.g., coupled, releasably coupled, etc.) into an existing fixture 2406.

Lamp 2500 includes a bulb 2501 having an end plug 2516 supported by a fixture 2506. The reservoir 2550 and envelope 2502 are located in the bulb 2501. The heater 2530, the cooler 2540, and the sensor 2562 are located in the end plug 2516. The control circuit 2560 and the energy storage device 2568 are located in the fixture 2506.

Lamp 2600 includes a bulb 2601 having an end plug 2616 supported by a fixture 2606. The reservoir 2650 is located in the bulb 2601. The sensor 2662 is located in the end plug 2616. The heater 2630, the cooler 2640, the control circuit 2660, and the energy storage device 2668 are located in the fixture 2606. The heater 2630 and the cooler 2640 are thermally coupled to the reservoir 2650, for example, by a thermally conductive pathway 2633. In such an embodiment, the more costly and durable components may be located in the fixture 2606, thereby keeping down the per piece cost of the replaceable bulb 2601.

Other embodiments not shown are further contemplated. For example, the heater and the cooler need not be in the same component, that is the heater may be in the bulb while the cooler is in the end plug, the heater may be in the end plug while the cooler is in the fixture, etc. Similarly, the control circuit and the energy storage device need not be in the same component, for example, the control circuit may be in the bulb while the energy storage device is in the end plug or fixture, the control circuit could be in the fixture while the energy storage device is in the end plug, etc.

When starting the lamps described herein, the lamp must vaporize on the order of several to tens of milligrams of the emissive material. Further, in a configuration in which the heater heats the entire envelope, on the order of dozens of grams of the lamp are also heated (e.g., inert gases, phosphors, etc.). The heat capacities involved may be on the order of 100 J/g to raise the temperatures from room temperature (approximately 25° C.) to a few hundred degrees Celsius. Thus, a single kilojoule may be sufficient to vaporize the emissive material during startup. However, due to the short period of time of startup, this may result in a temporarily high power draw on the electrical system that provides power to the lamp. Further, if a plurality of lamps are commanded on (e.g., switched on) substantially simultaneously, the power draw on the electrical system is multiplied. Accordingly, a startup system may be used to control the startup of the lamps to limit the overall power draw on the electrical system. According to one embodiment, a central controller may receive a startup command, and the central controller may then cause one or more lamps to startup in an order which limits the current draw on the system. For example, the central controller may start the lamps in series, in parallel, or in any combination thereof. According to other embodiments, a decentralized startup controller (e.g., a startup circuit, control startup circuit, etc., described below) may be coupled to and control the startup of each lamp such that the overall power draw of the plurality of lamps is maintained within acceptable limits during startup.

Figure 7:
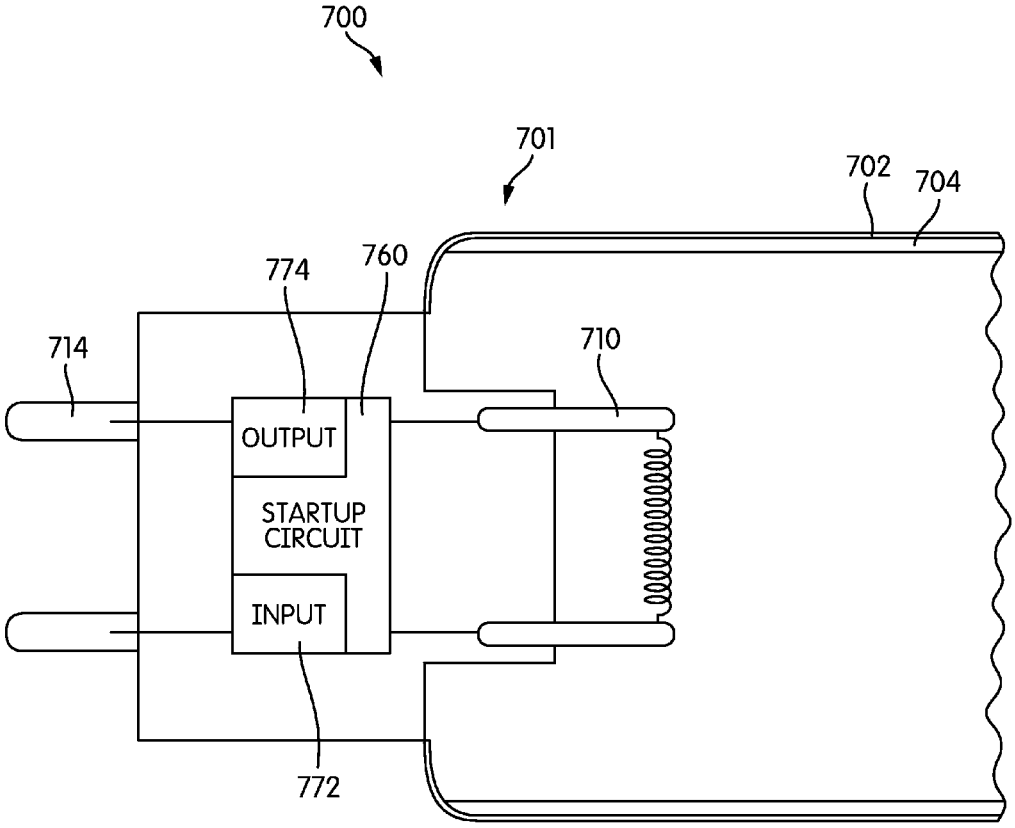
FIG. 7 is a schematic diagram of a portion of a lamp, shown according to another embodiment.
Figure 8:
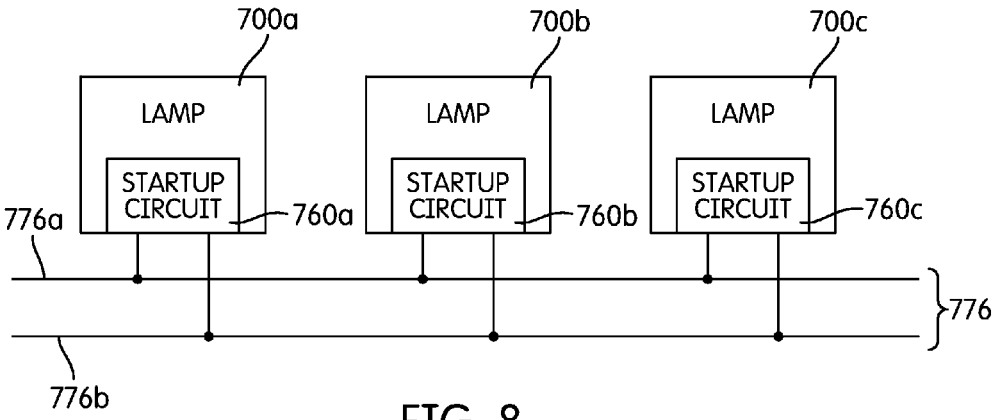
FIG. 8 is a schematic diagram of a plurality of the lamps of FIG. 7 coupled to an electrical system, shown according to an exemplary embodiment.

Referring to FIG. 7, a lamp 700 is shown according to an exemplary embodiment. Further referring to FIG. 8, a plurality of lamps 700, shown as first through third lamps 700*a-c*, are coupled to an electrical system 776. For example, the contacts 714 of the lamp 700 may couple to the power lines 776*a* and 776*b* of the electrical system 776.

The lamp 700 is shown to include a startup circuit 760 (e.g., a controller) coupled to the lamp 700. The startup circuit 760 may include any number of mechanical or electrical circuitry components or modules for controlling the startup of the lamp 700. For example, the startup circuit 760 may include a switch, a capacitor, an inductor, a resistor, or other solid state circuitry components. According to another embodiment, the startup circuit 760 may include a processor as described above. The processor may be or include one or more microprocessors, an application specific integrated circuit (ASIC), a circuit containing one or more processing components, a group of distributed processing components, circuitry for supporting a microprocessor, or other hardware configured for processing. According to an exemplary embodiment, the processor is configured to execute computer code stored in a memory to complete and facilitate the activities described herein. The memory can be any volatile or non-volatile memory device capable of storing data or computer code relating to the activities described herein. For example, the memory may include modules that are computer code modules (e.g., executable code, object code, source code, script code, machine code, etc.) configured for execution by the processor. When the code modules are executed by the processor, the control circuit is configured to complete the activities described herein.

According to one embodiment, the startup circuit 760 is configured start the lamp 700 at a time relative to a plurality of other lamps such that the current draw on an electrical system providing power to the lamp is maintained below a first power level.

According to another embodiment, the startup circuit 760 includes an input 772 configured to receive a startup signal from another lamp and an output 774 configured to transmit a startup signal. The startup circuit 760 is configured to delay starting the lamp 700 for a second period of time in response to the input 772 receiving a startup signal within a first period of time after the startup circuit 760 receives a startup command. The startup circuit 760 is further configured to start the lamp 700 and cause the output 774 to transmit (e.g., broadcast, output, provide, cause to be transmitted, etc.) a startup signal in response to the input 772 not receiving a startup signal within the first period of time after the startup circuit receives the startup command. The first and second periods of time may be random amounts of time and may be limited to less than one second. According to an exemplary embodiment, the startup signal may be passed over a power line 776*a*, 776*b*. According to other embodiments, the startup signal may be passed over a dedicated line, over a wired network connection, over another line, or wirelessly.

In operation, the system of this embodiment may act as a collision avoidance system. For example, the plurality of lamps 700 may receive the startup command at substantially the same time. Each of the lamps 700 then waits its first period of time. The lamp 700 with the first expiring period of time, for example lamp 700*a*, having not received a startup signal begins to start and broadcasts a startup signal to the other lamps 700 (e.g., lamps 700*b*, 700*c*). These other lamps 700*b*, 700*c* each wait its second period of time. The lamp having the first expiring second period of time, for example lamp 700*c*, having not received a startup signal during the second period of time begins to start and broadcasts a startup signal to the other lamps 700 (e.g., lamps 700*a*, 700*b*). Lamp 700*b* then waits a third period of time, and having not received a startup signal during the third period of time begins to startup and transmits a startup signal. The concepts of this system may be expanded to any number of lamps.

Figure 9:
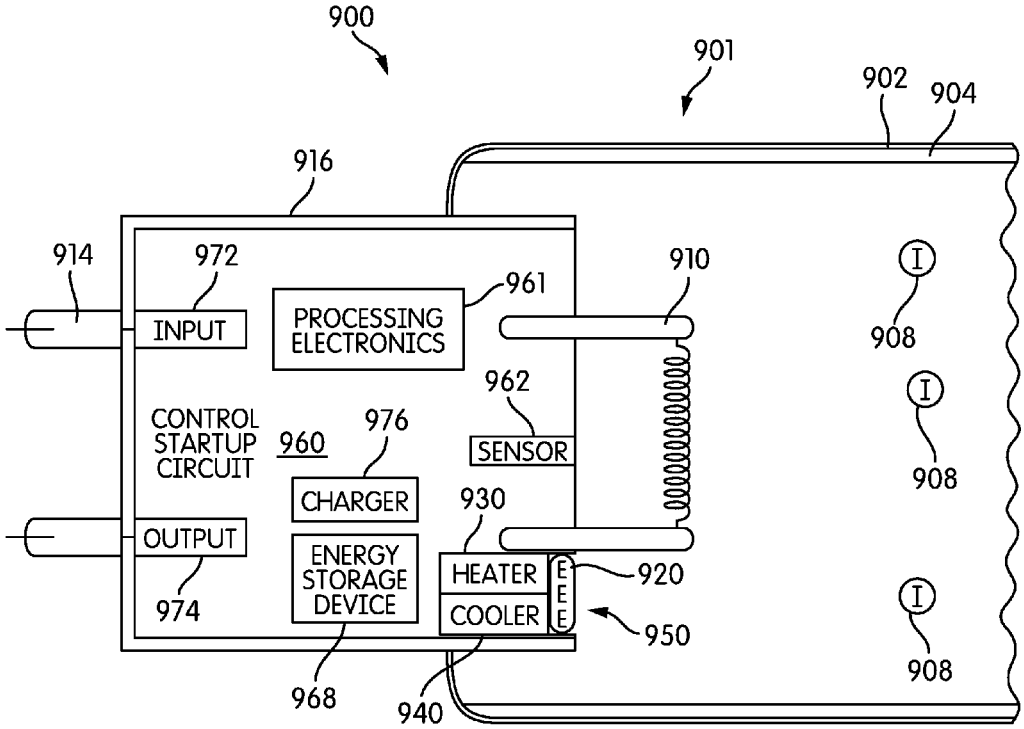
FIG. 9 is a schematic diagram of a portion of a lamp, shown according to another embodiment.

Referring to FIG. 9, a lamp 900 is shown according to an exemplary embodiment. The lamp 900 may be a mercury-free low-pressure lamp having a bulb 901 having one or more phosphors 904 configured to convert photons to visible wavelengths, having an envelope 902 filled with a gas at low pressure, and having at least one emissive material including at least one of an alkali metal and an alkaline earth metal. The envelope 902 may be filled with one or more inert gases 908. The lamp 900 further includes a control startup circuit 960 configured, in response to a startup command, to cause the vaporization of the emissive material into the envelope and to cause the excitation of the emissive material with an electron such that the emissive material in combination with the inert gases generate visible or ultraviolet photons. The control startup circuit 960 may be coupled to or incorporated into the lamp 900, for example, in the end plug 916, as shown; or, as shown in FIG. 11, the control startup circuit 1160 may be coupled to or incorporated into a fixture 1106 configured to support the bulb 1101 of the lamp 1100.

The control startup circuit 960 may include any number of mechanical or electrical circuitry components or modules for controlling the control startup of the lamp 900. For example, the control startup circuit 960 may include a switch, a capacitor, an inductor, a resistor, or other solid state circuitry components. According to another embodiment, the startup circuit 960 may include a processing electronics 961.

Figure 10:
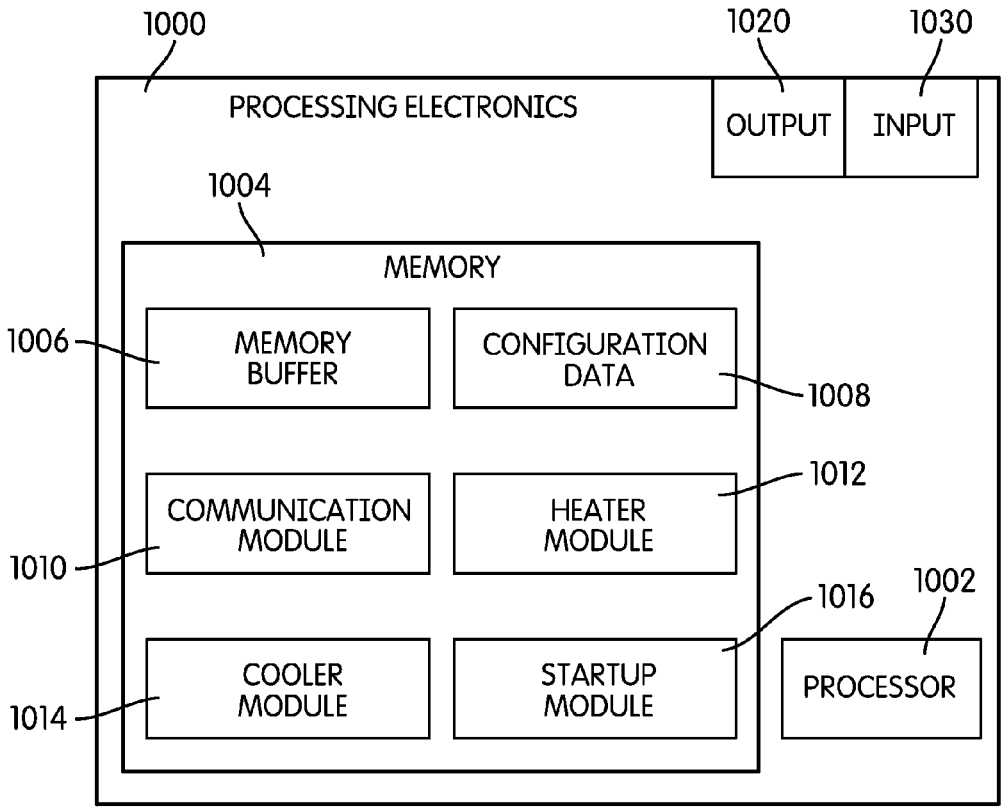
FIG. 10 is a detailed block diagram of the processing electronics of FIG. 9, shown according to an exemplary embodiment.

Referring now to FIG. 10, a detailed block diagram of processing electronics 1000 configured to execute the systems and methods of the present disclosure is shown, according to an exemplary embodiment. The processing electronics 1000, or components and modules thereof, may be included in the lamps of FIGS. 3-9, 11, and 23-26, for example, as part of control circuit 360, startup circuit 760, control startup circuit 960, control startup circuit 1160, control circuit 2360, control circuit 2460, control circuit 2560, or control circuit 2660. Processing electronics 1000 includes a memory 1004 and processor 1002. Processor 1002 may be or include one or more microprocessors, an application specific integrated circuit (ASIC), one or more field programmable gate arrays (FPGAs), a circuit containing one or more processing components, a group of distributed processing components, circuitry for supporting a microprocessor, or other hardware configured for processing. According to an exemplary embodiment, processor 1002 is configured to execute computer code stored in memory 1004 to complete and facilitate the activities described herein. Memory 1004 can be any non-transient, volatile or non-volatile memory device capable of storing data or computer code relating to the activities described herein. For example, memory 1004 is shown to include modules 1010-1016 which are computer code modules (e.g., executable code, object code, source code, script code, machine code, etc.) configured for execution by processor 1002. When executed by processor 1002, processing electronics 1000 is configured to complete the activities described herein. Processing electronics 1000 includes hardware circuitry for supporting the execution of the computer code of modules 1010-1016. For example, processing electronics 1000 includes hardware interfaces (e.g., output 1020) for communicating control signals (e.g., analog, digital) from processing electronics 1000 to control startup circuit 960. The output 1020 may be, include, or communicate with the output 974 of the circuit 960. Processing electronics 1000 may also include an input 1030 for receiving, for example, a startup command from input 972, feedback signals from the heater 930 or the cooler 940, or for receiving data or signals from other, sensors, systems, or devices. The input 1030 may be, include, or communicate with the input 972 of the circuit 960.

The memory 1004 is shown to include a memory buffer 1006. The memory buffer 1006 is configured to receive data via an input 1030. The data may include data from a temperature sensor or temperature controller, data from a optical sensor, data from an input relating to a startup signal or startup command, data that may be used to determine whether a heater or cooler should or should not be activated, or other data that may be used to determine whether a heater or cooler should or should not be deactivated.

The memory 1004 further includes configuration data 1008. The configuration data 1008 includes data relating to the processing electronics 1000 or to various controllers, thermal sensors, or optical sensors. For example, the configuration data 1008 may include information relating to a retrieval process of data from a sensor (e.g., transfer functions for thermocouples, photocells, etc.). The configuration data 1008 may also include data regarding the number, size and orientation of reservoirs, heaters, and coolers. For example, a high lumen output lamp may have more emissive material and more reservoirs.

The memory 1004 is shown to include a communication module 1010. The communication module 1010 is configured to provide communication capability with other components of the circuit 960 via the output 1020. For example, the communication module 1010 may be configured to activate or deactivate the heater 930 or the cooler 940 in response to a determination by the heater module 1012 or the cooler module 1014, respectively. The communication module 1010 may be configured to receive a startup command and to cause a startup signal to be transmitted.

The memory 1004 is shown to include a heater module 1012 configured to control the heater 930. The heater module 1012 may be configured to cause the heater 930 to heat or cease heating, for example, in response to a startup command, a signal from a sensor 962, or a command from the startup module 1016. The heater module 1012 may be configured to control the operation of various heaters 930 such that a plurality of reservoirs 950 and/or the emissive material 920 therein may be heated sequentially, simultaneously, or any combination thereof.

The memory 1004 is shown to include a cooler module 1014 configured to control the cooler 940. The cooler module 1014 may be configured to cause the cooler 940 to cool or cease cooling, for example, in response to a startup command, a shutdown command, a signal from a sensor 962, or a command from the startup module 1016. For example, in the case where the lamp 900 is switched off and then soon after switched back on, the cooler module 1014 may cause the cooler 940 to cool in response to the shutdown command, but may then cause the cooler 940 to cease cooling in response to the startup command. The cooler module 1014 may further include logic for charging and discharging the energy storage device 968, for example, via a charger 976 coupled to the contacts 914, a photovoltaic cell (e.g., sensor 962), or a thermoelectric generator.

The memory 1004 is shown to include a startup module 1016. The startup module 1016 is configured to cause the lamp 900 to startup in response to a startup command. For example, the startup module 1016 may control the ballast, for example, if the ballast is an electronic ballast. The startup module 1016 may include a timer and logic for generating a random value for use with a decentralized startup control system. The startup module 1016 may communicate with the communication module 1010 to receive a startup command and to cause transmission of a startup signal. For example, the startup module 1016 may include logic for carrying out the processes of startup circuit 760 as described above with respect to FIGS. 7 and 8. According to other embodiments, the startup module 1016 may include logic for controlling an injector and carrying out the processes as described in relation to FIGS. 18-20.

Returning to FIG. 9, the control startup circuit 960 may include or couple to the heater 930 configured to raise the temperature of a first portion (e.g., the reservoir 950) of the lamp 900 and/or the emissive material 920 therein such that the vapor pressure of the emissive material 920 is increased such that the emissive material 920 begins to vaporize. The control startup circuit 960 may be configured to switch off the heater 930 in response to an input, for example, the passage of time, a temperature of the lamp 900, an optical output of the lamp 900, or an electrical state of the lamp 900. The control startup circuit 960 may include or couple to the cooler 940 configured to reduce the temperature of at least a second portion (e.g., the reservoir 950) of the lamp 900 such that the emissive material 920 preferentially condenses at the second portion of the lamp 900. The control startup circuit 960 may be configured to switch off the cooler 940 in response to an input, for example, a profile of time, a temperature of the lamp 900, an optical output of the lamp 900, an electrical property of the lamp 900, a startup command, etc. The control startup circuit 960 may be configured to provide power to the heater 930 and the cooler 940. For example the control startup circuit 960 may include or pass on power from an energy storage device 968 or may pass on power from a power supply coupled to the contacts 914.

Referring generally to FIGS. 12-17, various processes for operating a mercury-free low-pressure arc discharge lamp are shown. The processes of FIGS. 12-17 may be implemented by the various systems described in FIGS. 1-11.

Figure 12:
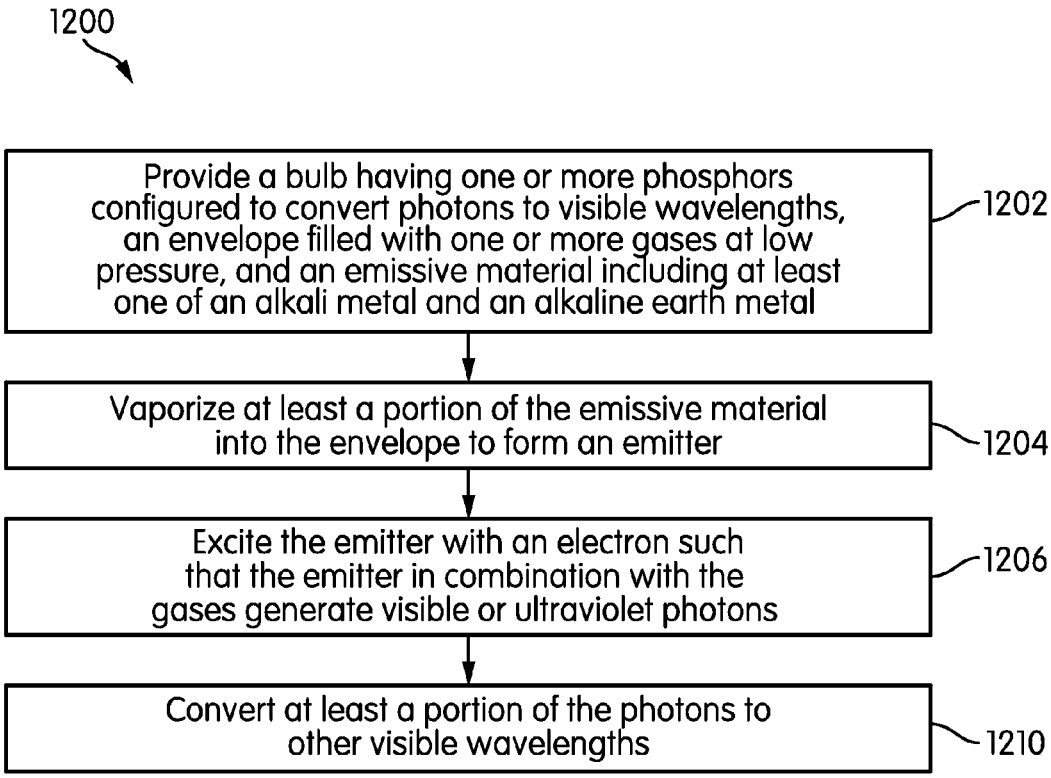
FIG. 12 is a flowchart of a process of operating a lamp, shown according to an exemplary embodiment.

Referring to FIG. 12, a flowchart of a process 1200 for operating a low-pressure arc discharge lamp is shown, according to an exemplary embodiment. The process 1200 includes the steps of providing a bulb having one or more phosphors configured to convert photons to visible wavelengths, an envelope filled with one or more gases at low pressure, and an emissive material including at least one of an alkali metal and an alkaline earth metal (step 1202), vaporizing at least a portion of the emissive material into the envelope to form an emitter (step 1204), exciting the emitter with an electron such that the emitter in combination with the gases generate visible or ultraviolet photons (step 1206), and converting at least a portion of the photons to other visible wavelengths (step 1208).

Figure 13:
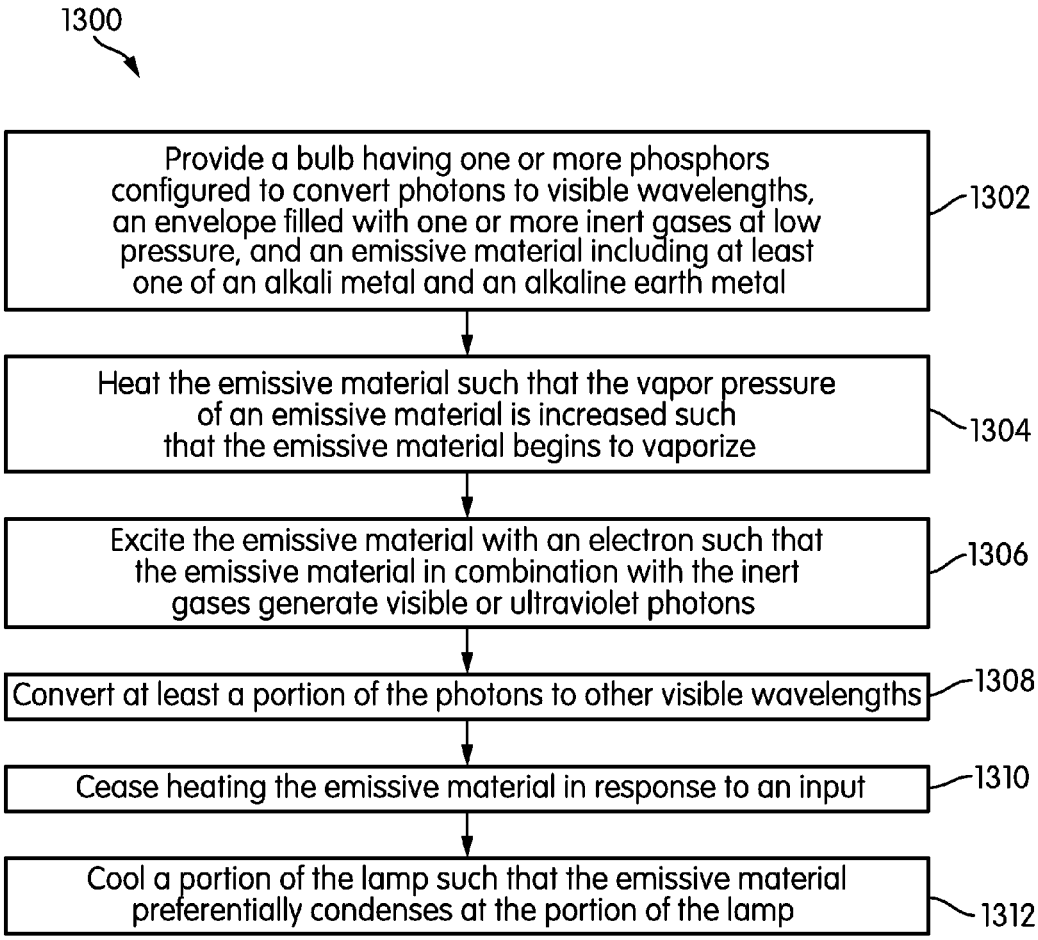
FIG. 13 is a flowchart of a process of operating a lamp, shown according to another embodiment.

Referring to FIG. 13, a flowchart of a process 1300 for operating a low-pressure arc discharge lamp is shown, according to an exemplary embodiment. The process 1300 includes the steps of providing a bulb having one or more phosphors configured to convert photons to visible wavelengths, an envelope filled with one or more inert gases at low pressure, and an emissive material including at least one of an alkali metal and an alkaline earth metal (step 1302), and heating the emissive material such that the vapor pressure of an emissive material is increased such that the emissive material begins to vaporize (step 1304). The process 1300 further includes the steps of exciting the emissive material with an electron such that the emissive material in combination with the inert gases generate visible or ultraviolet photons (step 1306), converting at least a portion of the photons to other visible wavelengths (step 1308), ceasing heating in response to an input (step 1310), and cooling a portion of the lamp such that the emissive material preferentially condenses at the second portion of the lamp (step 1312).

Figure 14:
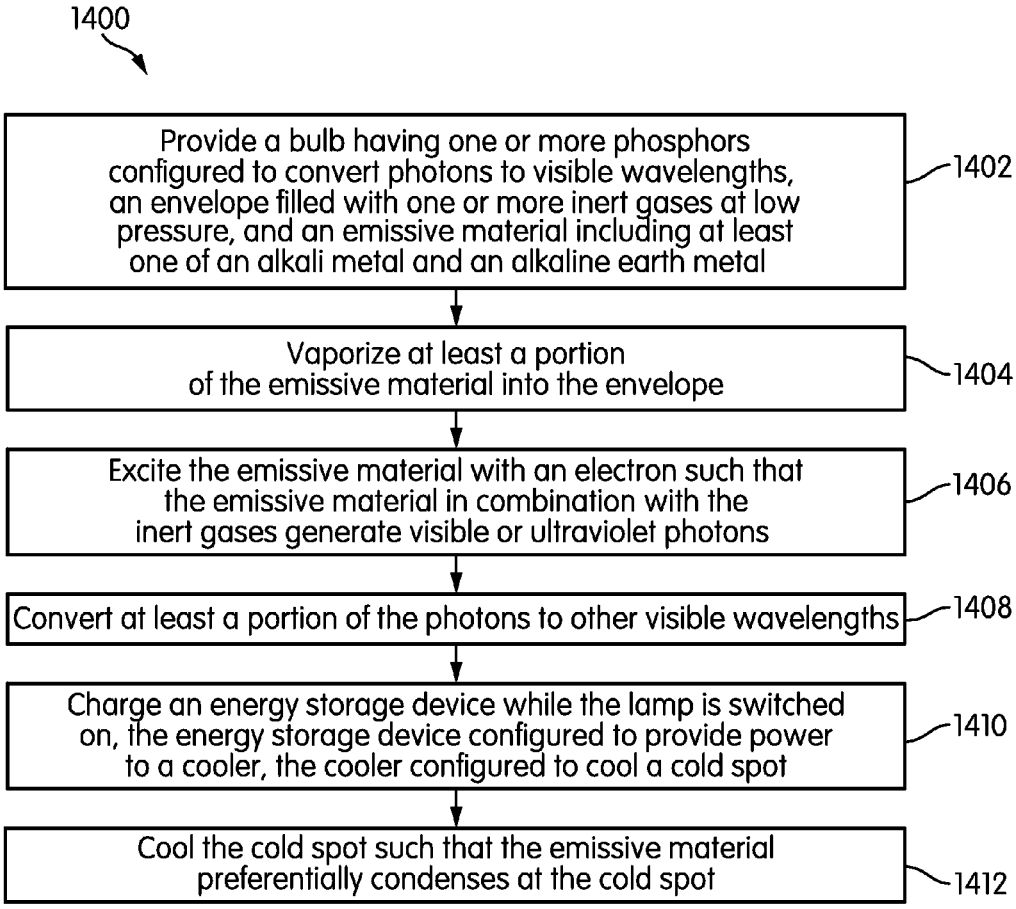
FIG. 14 is a flowchart of a process of operating a lamp, shown according to another embodiment.

Referring to FIG. 14 a flowchart of a process 1400 for operating a low-pressure arc discharge lamp is shown, according to an exemplary embodiment. The process 1400 includes the steps of providing a bulb having one or more phosphors configured to convert photons to visible wavelengths, an envelope filled with one or more inert gases at low pressure, and an emissive material including at least one of an alkali metal and an alkaline earth metal (step 1402), vaporizing at least a portion of the emissive material into the envelope (step 1404), exciting the emissive material with an electron such that the emissive material in combination with the inert gases generate visible or ultraviolet photons (step 1406), and converting at least a portion of the photons to other visible wavelengths (step 1408). The process 1400 further includes the step of charging an energy storage device while the lamp is switched on, the energy storage device configured to provide power to a cooler, the cooler configured to cool a cold spot (step 1410). The process 1400 further includes the step of cooling the cold spot such that the emissive material preferentially condenses at cold spot of the lamp (step 1412).

Figure 15:
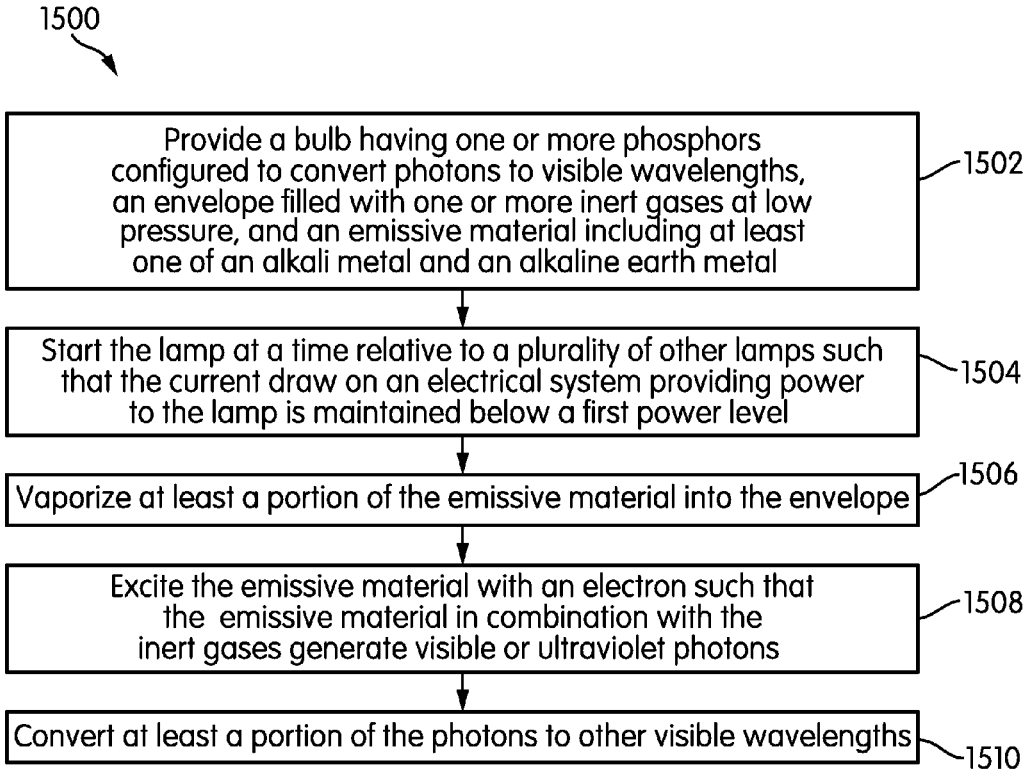
FIG. 15 is a flowchart of a process of operating a lamp, shown according to another embodiment.

Referring to FIG. 15 a flowchart of a process 1500 for operating a low-pressure arc discharge lamp is shown, according to an exemplary embodiment. The process 1500 includes the steps of providing a bulb having one or more phosphors configured to convert photons to visible wavelengths, an envelope filled with one or more inert gases at low pressure, and an emissive material including at least one of an alkali metal and an alkaline earth metal (step 1502), and starting the lamp at a time relative to a plurality of other lamps such that the current draw on an electrical system providing power to the lamp is maintained below a first power level (step 1504). The process 1500 further includes the steps of vaporizing at least a portion of the emissive material into the envelope (step 1506), exciting the emissive material with an electron such that the emissive material in combination with the inert gases generate visible or ultraviolet photons (step 1508), and converting at least a portion of the photons to other visible wavelengths (step 1510).

Figure 16:
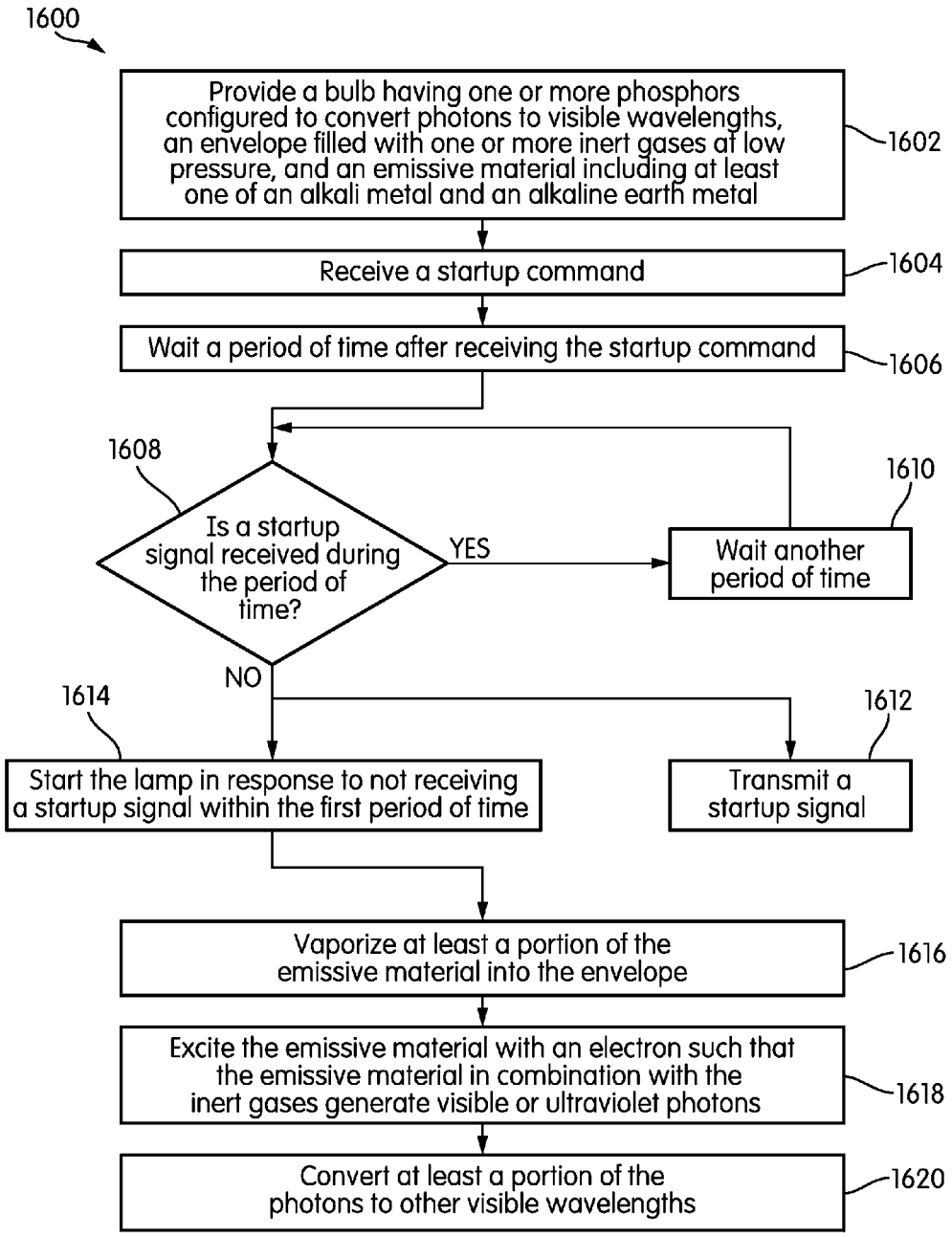
FIG. 16 is a flowchart of a process of operating a lamp, shown according to another embodiment.

Referring to FIG. 16 a flowchart of a process 1600 for operating a low-pressure arc discharge lamp is shown, according to an exemplary embodiment. The process 1600 includes the steps of providing a bulb having one or more phosphors configured to convert photons to visible wavelengths, an envelope filled with one or more inert gases at low pressure, and an emissive material including at least one of an alkali metal and an alkaline earth metal (step 1602), receiving a startup command (step 1604), and waiting a period of time after receiving the startup command (step 1606). The process 1600 then determines if a startup signal is received during the period of time (step 1608). If a startup signal is received during the period of time, then the process 1600 waits another period of time before returning to the determining step 1608 (step 1610). If a startup signal is not received during the period of time, then the process 1600 proceeds to starting the lamp (step 1614). The process 1600 further includes the steps of vaporizing at least a portion of the emissive material into the envelope (step 1616), exciting the emissive material with an electron such that the emissive material in combination with the inert gases generate visible or ultraviolet photons (step 1618), and converting at least a portion of the photons to other visible wavelengths (step 1620).

Figure 17:
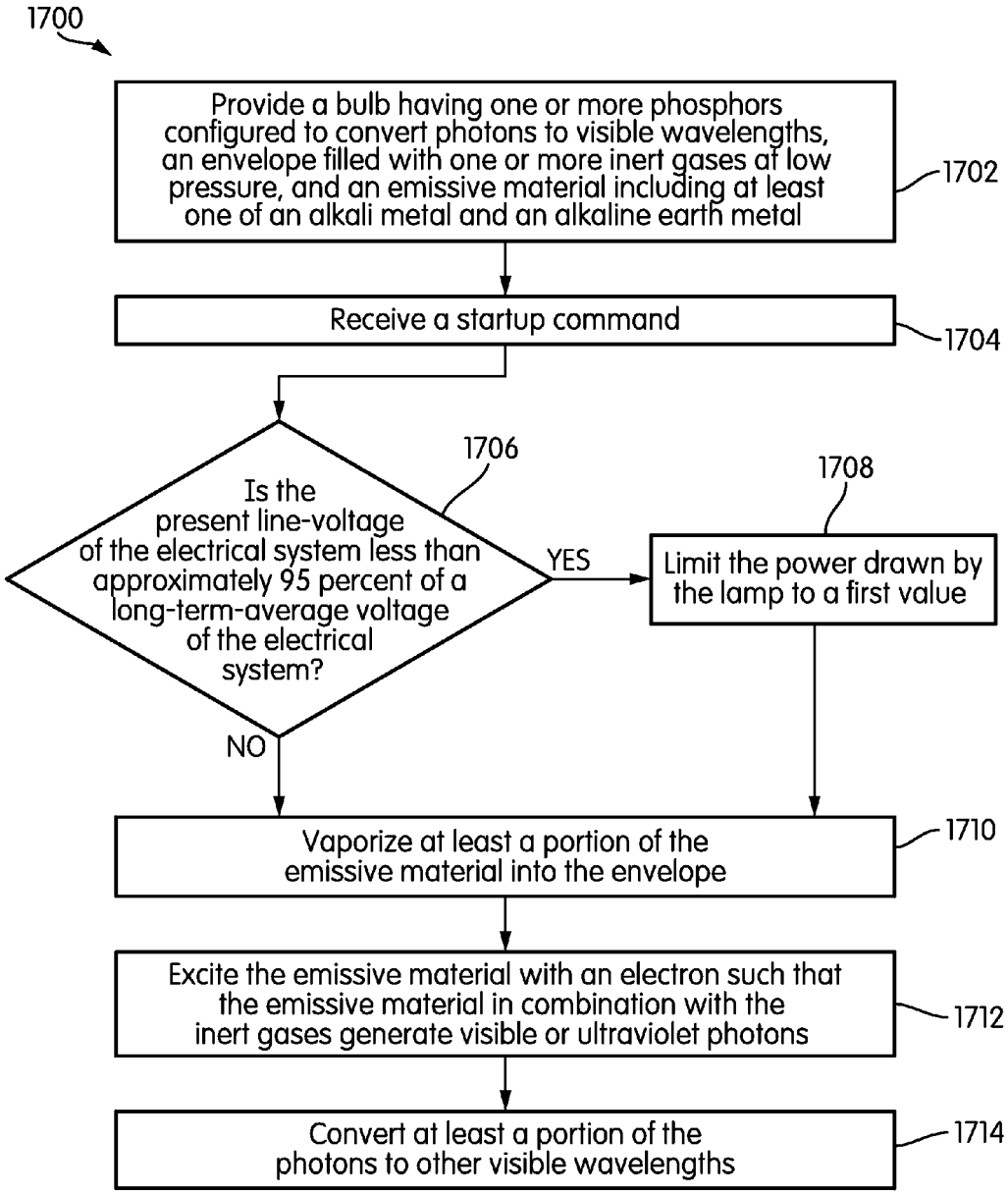
FIG. 17 is a flowchart of a process of operating a lamp, shown according to another embodiment.

Referring to FIG. 17 a flowchart of a process 1700 for operating a low-pressure arc discharge lamp is shown, according to an exemplary embodiment. The process 1700 includes the steps of providing a bulb having one or more phosphors configured to convert photons to visible wavelengths, an envelope filled with one or more inert gases at low pressure, and an emissive material including at least one of an alkali metal and an alkaline earth metal (step 1702), receiving a startup command (step 1704). The process 1700 then determines if the present line-voltage of the electrical is less than approximately 95 percent of a long-term-average voltage of the electrical system (step 1706). If the determination is yes, then the process limits the power drawn by the lamp to a first value (step 1708) and proceeds to vaporizing at least a portion of the emissive material into the envelope (step 1710). If the determination is no, the process 1700 proceeds directly to the vaporizing step 1710 without limiting the power drawn. The process 1700 further includes the steps of exciting the emissive material with an electron such that the emissive material in combination with the inert gases generate visible or ultraviolet photons (step 1712), and converting at least a portion of the photons to other visible wavelengths (step 1714).

Figure 18:
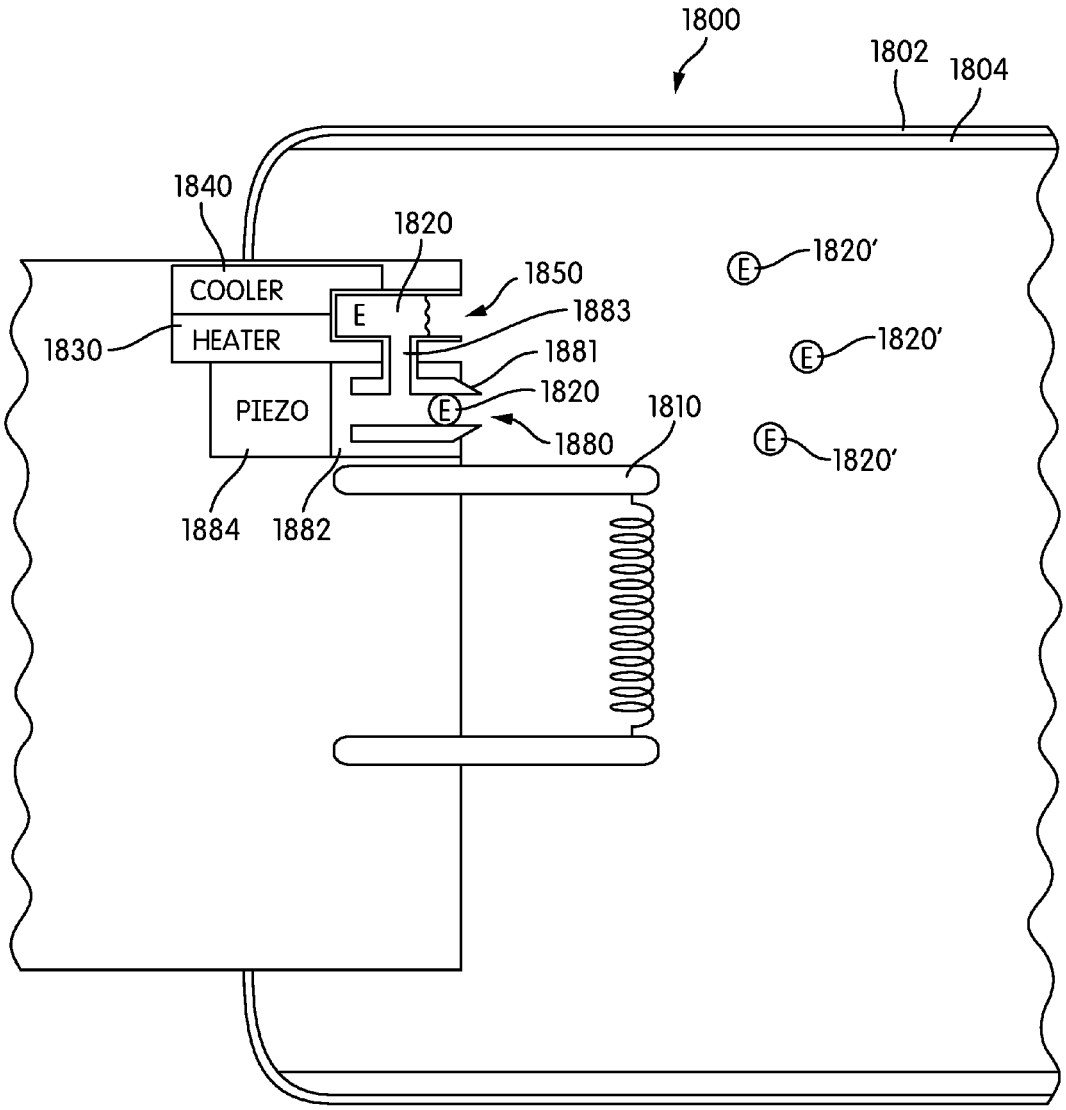
FIG. 18 is a schematic diagram of a portion of a lamp, shown according to another embodiment.
Figure 19:
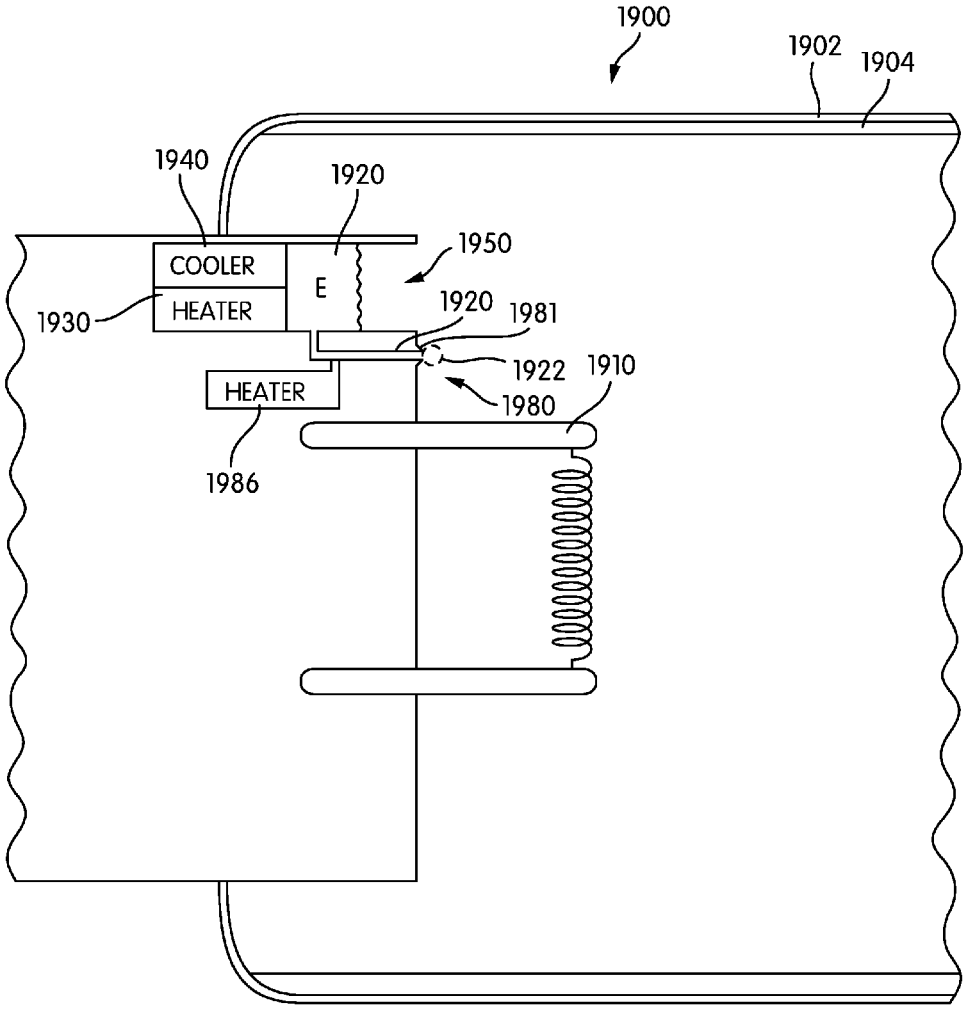
FIG. 19 is a schematic diagram of a portion of a lamp, shown according to another embodiment.
Figure 20:
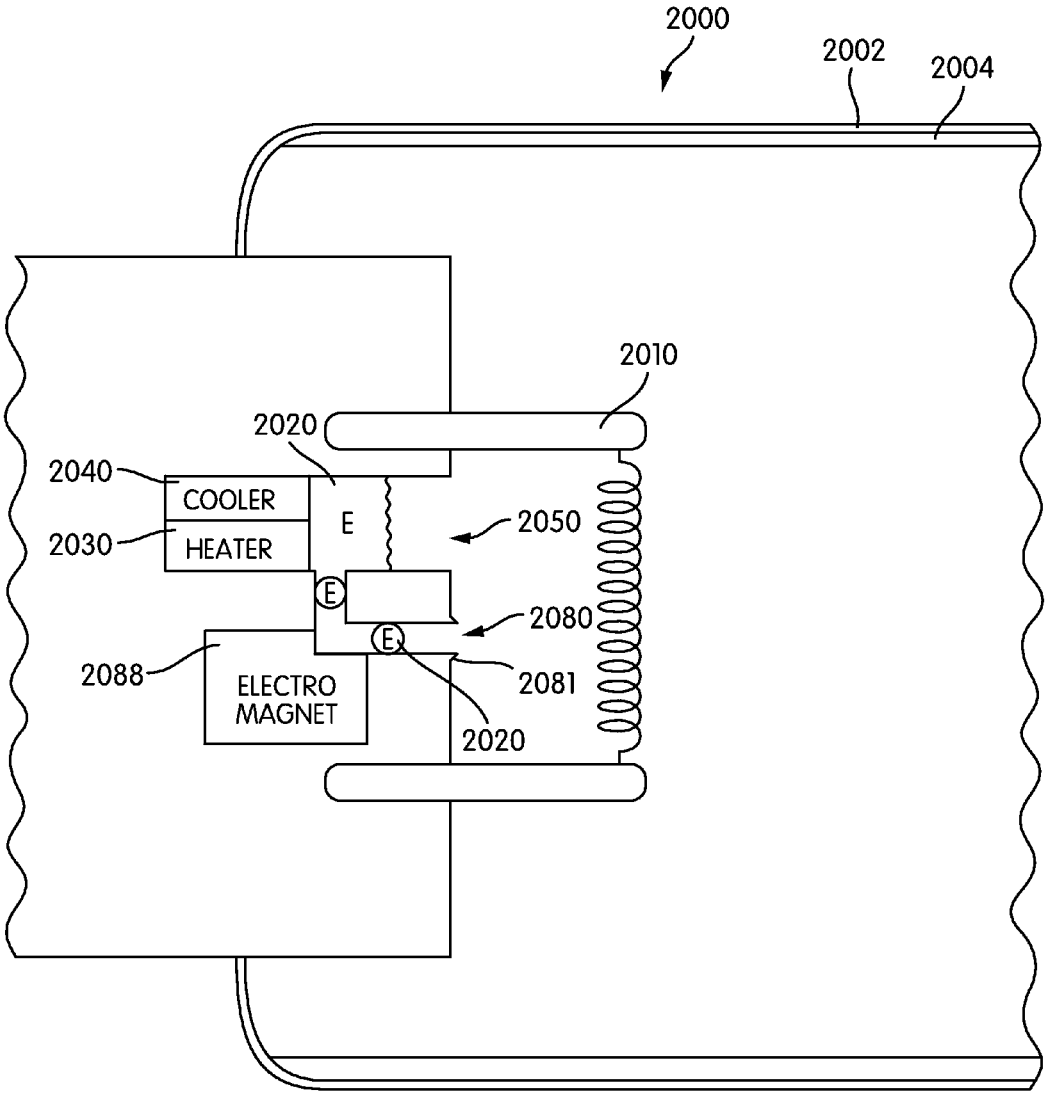
FIG. 20 is a schematic diagram of a portion of a lamp, shown according to another embodiment.

Referring to FIGS. 18-20, lamps 1800, 1900, and 2000 are shown, according to exemplary embodiments. As described above, the lamps 1800, 1900, 2000 are low-pressure lamps (e.g., arc discharge lamps) using a non-mercury emissive material 1820, 1920, 2020. Due the relatively low vapor pressure of the non-mercury emissive material, the lamps 1800, 1900, 2000 include an injector 1880, 1980, 2080 (e.g., sprayer, atomizer, jet, etc.) configured to spray (e.g., inject, discharge, etc.) at least some of the emissive material 1820, 1920, 2020 into the envelope 1802, 1902, 2002. According to exemplary embodiments, a controller (e.g., startup circuit 760, control startup circuit 960, startup module 1016, etc.) may be configured to control actuation of the injector 1880, 1980, 2080.

Referring to FIG. 18, the injector 1880 is shown to include a nozzle 1881 and an injection chamber 1882. A capillary

1883 is configured to move (e.g., draw, transport, etc.) the emissive material from the reservoir 1850 to the injection chamber 1882. A cooler 1840 may be coupled to the reservoir 1850 to induce condensation the emissive material 1820 at the reservoir 1850 after the prior shutdown. A heater 1830 may be coupled to the reservoir 1850 in order heat the emissive material 1820 prior to injection. Heating the emissive material 1820 raises the vapor pressure of the emissive material 1820, facilitating a finer spray and increases the fluidity of the emissive material 1820, facilitating flow of the emissive material 1820 from the reservoir 1850 to the injection chamber 1882. Depending on the materials used for the emissive material 1820, the heater 1830 may melt a solidified emissive material 1820 in the reservoir 1850 so that the emissive material 1820 can be more easily sprayed by the injector 1880.

According to the embodiment shown, the injector 1880 uses a piezoelectric element 1884 to create a pressure wave in the injection chamber 1882. The pressure wave pushes at least some of the emissive material 1820 into the envelope 1802. The emissive material 1820 that is sprayed into the envelope 1802 may be sufficiently atomized that the emissive material 1820 can be excited by electrons and ions in the envelope 1802. According to another embodiment, the emissive material 1820 that is sprayed into the envelope 1802 may be sufficiently fine that an ionized gas (e.g., plasma) in the envelope 1802 may quickly and easily vaporize the emissive material 1820 such that the emissive material 1820 can be excited in order to produces photons.

Referring to FIG. 19, the emissive material 1920 flows into an injection chamber 1982. A heater 1986, which may be the same or separate from the heater 1930, heats the emissive material 1920 in the injection chamber 1982 causing the emissive material 1920 to expand. At least some of the emissive material 1920 is pushed out of the injection chamber 1982 through the nozzle 1981. According to one embodiment, the emissive material 1920 expelled through the nozzle 1981 forms a bubble 1922. Continued heating of the emissive material 1920 by the heater 1986 causes the bubble 1922 to pop, releasing particles of the emissive material 1920 into the envelope. The particles of the emissive material 1920 may be sufficiently fine to release photons in response to electronic excitation or may be sufficiently fine to be quickly and easily vaporized by the ionized gas in the envelope 1902.

Referring to FIG. 20, the emissive material 2020 may be conductive as a liquid. Accordingly, an electromagnet 2088 may be used to generate a force to act upon the emissive material 2020. The electromagnetic force draws the emissive material 2020 from the reservoir 2050 and forces the emissive material 2020 into the envelope 2002 through the nozzle 2081. The nozzle 2081 may be configured to cause the discharged emissive material 2020 to form a mist of emissive material 2020 particles. The particles of the emissive material 2020 may be sufficiently fine to release photons in response to electronic excitation or may be sufficiently fine to be quickly and easily vaporized by the ionized gas in the envelope 2002.

Figure 21:
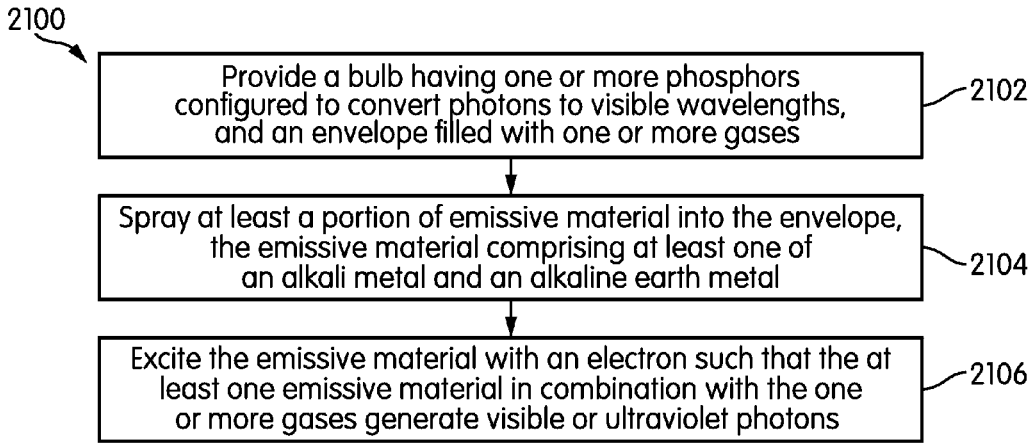
FIG. 21 is a flowchart of a process of starting a lamp, shown according to an exemplary embodiment.
Figure 22:
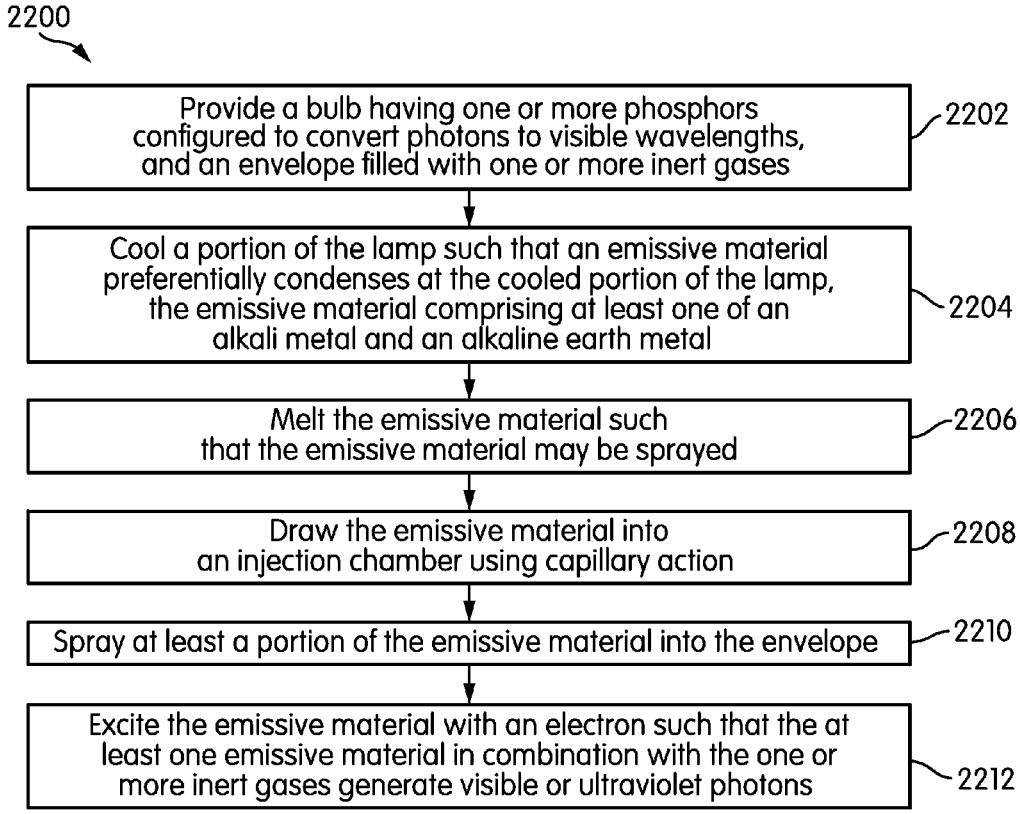
FIG. 22 is a flowchart of a process of starting a lamp, shown according to another embodiment.
Figure 24:
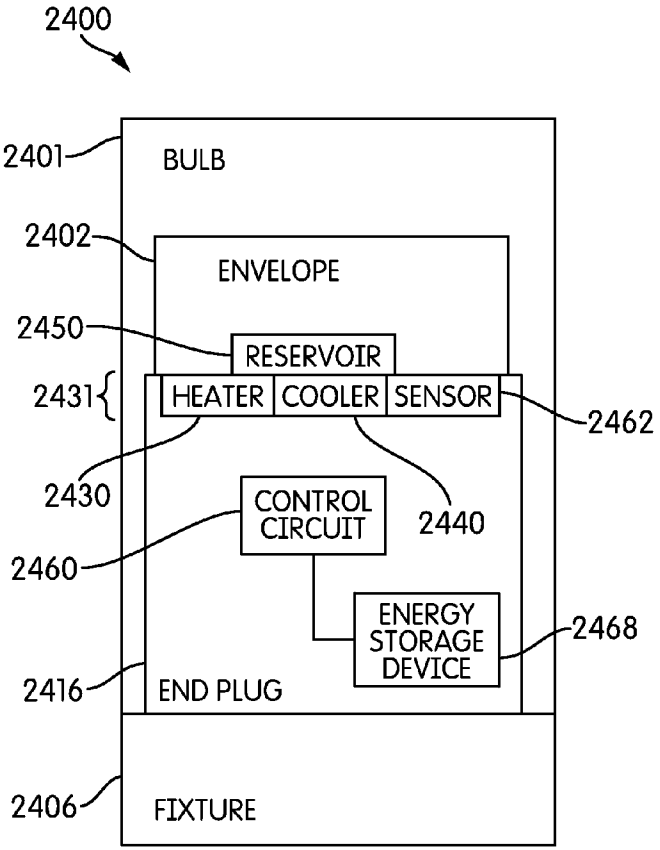
FIG. 24 is a schematic diagram of a lamp, shown according to another embodiment.
Figure 23:
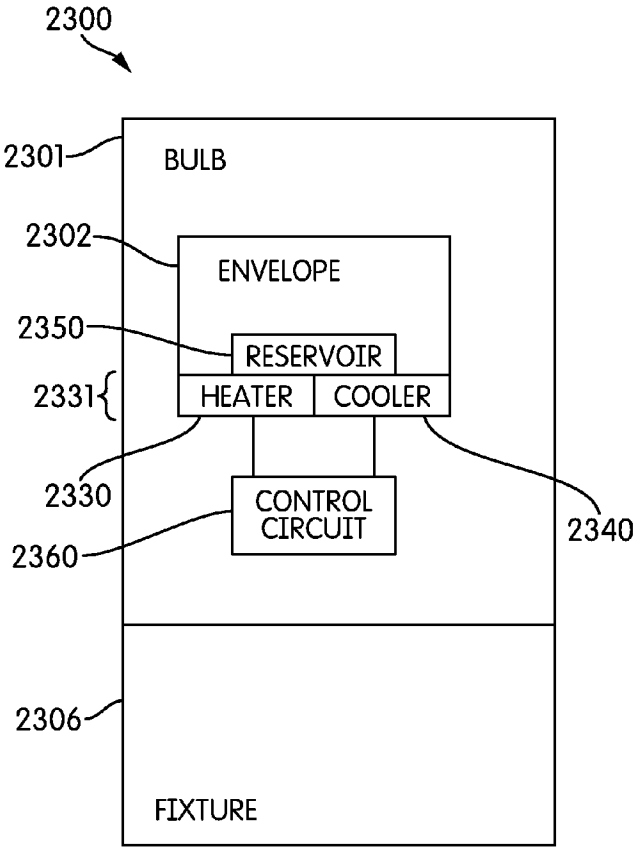
FIG. 23 is a schematic diagram of a lamp, shown according to another embodiment.
Figure 26:
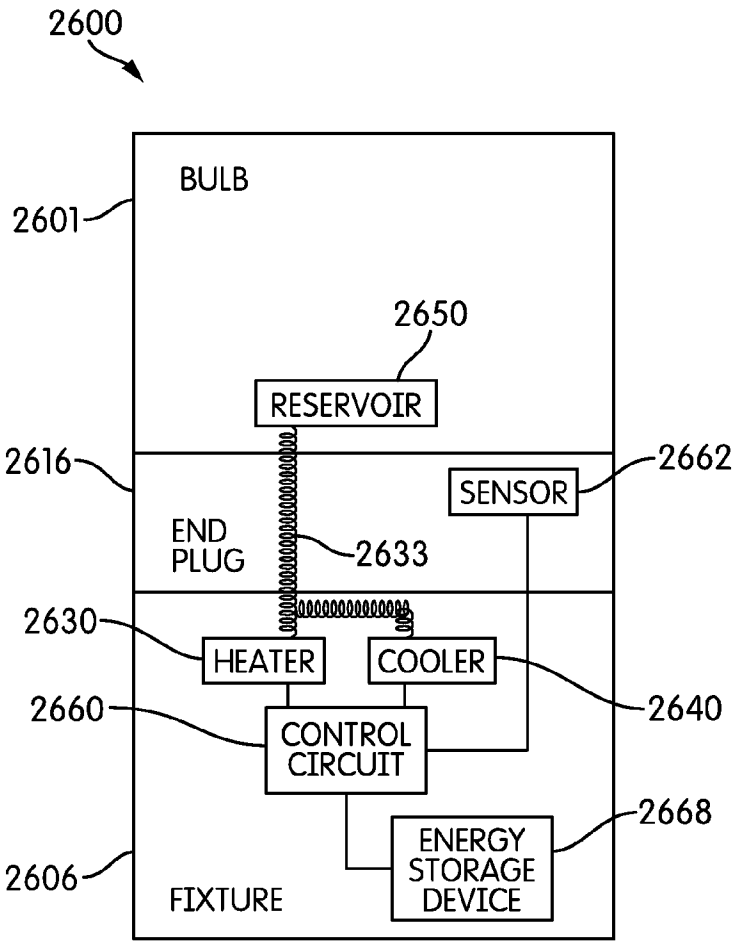
FIG. 26 is a schematic diagram of a lamp, shown according to another embodiment.
Figure 25:
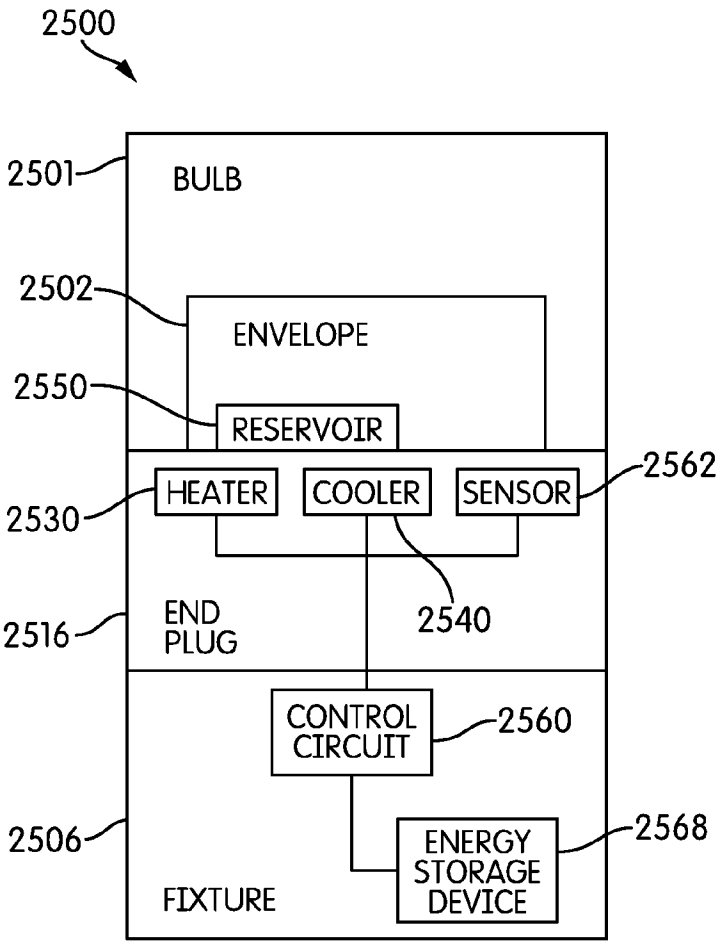
FIG. 25 is a schematic diagram of a lamp, shown according to another embodiment.

Referring generally to FIGS. 21-22, various processes for operating a mercury-free low-pressure arc discharge lamp are shown. The processes of FIGS. 21-22 may be implemented by the various systems described in FIGS. 18-20.

Referring to FIG. 21, a flowchart of a process 2100 for starting a low-pressure arc discharge lamp is shown, according to an exemplary embodiment. The process 2100 includes the steps of providing a bulb having one or more phosphors configured to convert photons to visible wavelengths and an envelope filled with one or more gases (e.g., inert gases) (step 2102), spraying at least a portion of the emissive material into the envelope, the emissive material comprising at least one of an alkali metal and an alkaline earth metal (step 2104), and exciting the emissive material with an electron such that the at least one emissive material in combination with the one or more gases generate visible or ultraviolet photons (step 2106).

Referring to FIG. 22, a flowchart of a process 2200 for starting a low-pressure arc discharge lamp is shown, according to another embodiment. The process 2200 includes the steps of providing a bulb having one or more phosphors configured to convert photons to visible wavelengths and an envelope filled with one or more inert gases (step 2202), and cooling a portion of the lamp such that an emissive material preferentially condenses at the cooled portion of the lamp, the emissive material comprising at least one of an alkali metal and an alkaline earth metal (step 2204). The process 2200 further includes the steps of melting the emissive material such that the emissive material may be sprayed (step 2206), drawing the emissive material into an injection chamber using capillary action (step 2208), spraying at least a portion of the emissive material into the envelope, (step 2210), and exciting the emissive material with an electron such that the at least one emissive material in combination with the one or more inert gases generate visible or ultraviolet photons (step 2212). According to an exemplary embodiment, a period of time may lapse between the cooling step 2204 and the melting step 2006. For example, the cooling step 2204 may occur during or after prior operation of the lamp, and a period of seconds, minutes, hours, days, weeks, months, or years may pass between the cooling step 2206 and the melting step 2206, which may be triggered in response to a startup command.

The construction and arrangement of the elements of the systems and methods as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. It should be noted that the elements and assemblies described herein may be constructed from any of a wide variety of materials that provide sufficient strength or durability, in any of a wide variety of colors, textures, and combinations. Additionally, in the subject description, the word "exemplary" is used to mean serving as an example, instance, or illustration. Any embodiment or design described herein as "exemplary" is not necessarily to be construed as preferred or advantageous over other embodiments or designs. Rather, use of the word exemplary is intended to present concepts in a concrete manner. Accordingly, all such modifications are intended to be included within the scope of the present inventions. The order or sequence of any process or method steps may be varied or re-sequenced according to alternative embodiments. Other substitutions, modifications, changes, and omissions may be made in the design, operating conditions, and arrangement of the preferred and other exemplary embodiments without departing from scope of the present disclosure or from the scope of the appended claims.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision step.

What is claimed is:

1. A mercury-free low-pressure arc discharge lamp, comprising:

a bulb comprising:

an emissive material including at least one of an alkali metal or an alkaline earth metal, wherein:

when the bulb is in a non-operational state, the emissive material condenses into a liquid or solid; and when the bulb is in an operational state the emissive material forms an emitter, the emitter in combination with one or more gases generate photons when excited by an electrical discharge; and one or more phosphors configured to convert at least a portion of the photons to other visible wavelengths; and a thermal controller comprising a cooler and configured to at least partially control the energy of the emissive material.

2. The lamp of claim 1, wherein the bulb comprises a surface, the one or more phosphors at least partially lining the surface.

3. The lamp of claim 2, further comprising an envelope containing the emissive material and gases therein at a pressure below 0.01 atmospheres.

4. The lamp of claim 1, wherein the thermal controller is coupled to the bulb.

5. The lamp of claim 4, wherein the bulb comprises an envelope containing the emissive material and the gases, and wherein the thermal controller is located in the envelope.

6. The lamp of claim 1, further comprising a fixture configured to support the bulb;

wherein the thermal controller is coupled to the fixture.

7. The lamp of claim 6, wherein the bulb is releasably coupled to the fixture.

8. The lamp of claim 1, wherein the thermal controller comprises a heater.

9. The lamp of claim 8, wherein the heater is configured to raise the temperature of the emissive material.

10. The lamp of claim 8, wherein the heater is configured to raise the vapor pressure of the emissive material above a threshold pressure for maintaining a discharge.

11. The lamp of claim 8, wherein the heater is configured to heat a portion of an envelope containing the emissive material and the gases.

12. The lamp of claim 11, wherein the heater is configured to heat the entire envelope.

13. The lamp of claim 8, further comprising at least one reservoir configured to receive the emissive material;

wherein the heater is configured to heat the emissive material in the at least one reservoir.

14. The lamp of claim 1, wherein the cooler is configured to induce condensation of the emissive material at a cold spot.

15. The lamp of claim 14, wherein the cold spot is proximate a reservoir configured to receive the emissive material.

16. The lamp of claim 15, wherein the cold spot comprises the reservoir, the reservoir configured to be heated by a heater.

17. The lamp of claim 14, wherein the cold spot is remote from a reservoir, and wherein the lamp is configured such that the emissive material that is in a liquid state at the cold spot flows to the reservoir.

18. The lamp of claim 1, wherein the emissive material comprises Na2K.

19. A method of operating a mercury-free low-pressure lamp comprising:

providing a bulb comprising:

one or more phosphors configured to convert photons to visible wavelengths of light;

an envelope filled with one or more gases at a low pressure; and an emissive material including at least one of an alkali metal or an alkaline earth metal;

vaporizing at least a portion of the emissive material into the envelope to form an emitter;

exciting the emitter with an electron such that the emitter in combination with the gases generate visible or ultraviolet photons;

converting at least a portion of the photons to other visible wavelengths; and cooling a portion of the bulb such that the emissive material preferentially condenses at a first portion of the bulb.

20. The method of claim 19, further comprising ionizing the emissive material to form the emitter.

21. The method of claim 19, further comprising heating the emissive material.

22. The method of claim 21, wherein the heating step raises the temperature of the emissive material to at least the boiling point of the emissive material.

23. The method of claim 21, wherein the bulb comprises at least one reservoir configured to receive the emissive material, and wherein the heating step comprises heating the emissive material in the at least one reservoir.

24. The method of claim 23, wherein the heating step comprises heating a plurality of the at least one reservoirs sequentially.

25. The method of claim 23, wherein the heating step comprises heating a plurality of the at least one reservoirs simultaneously.

26. The method of claim 19, wherein the cooling step reduces the temperature of the first portion via active cooling.

27. The method of claim 26, wherein the cooling step is performed by a cooler configured to cool the first portion by forcing a fluid over a second portion thermally coupled to the first portion.

28. The method of claim 26, wherein the cooling step is performed by a cooler powered by an energy storage device coupled to the lamp.

29. An apparatus for operating a mercury-free low-pressure lamp including a bulb having: one or more phosphors configured to convert photons to visible or other visible wavelengths, an envelope filled with one or more gases at a pressure below 0.01 atmospheres, and at least one emissive material including at least one of an alkali metal and an alkaline earth metal, the apparatus comprising:

a circuit configured, in response to a startup command, to cause the emissive material to vaporize into the envelope to form an emitter and to cause an excitation of the emitter with an electron such that the emitter in combination with the gases generate visible or ultraviolet photons, the circuit comprising a cooler configured to remove energy from the emitter such that the emitter preferentially condenses at a first portion of the lamp.

30. The apparatus of claim 29, wherein the circuit comprises a heater, the heater configured to provide energy to the emissive material.

31. The apparatus of claim 30, wherein the lamp comprises at least one reservoir configured to receive the emissive material upon shutdown of the lamp, and wherein the heater is configured to heat the emissive material in the reservoir.

32. The apparatus of claim 31, wherein the circuit is configured to heat a plurality of reservoirs sequentially.

33. The apparatus of claim 31, wherein the circuit is configured to heat a plurality of reservoirs simultaneously.

34. The apparatus of claim 31, wherein the circuit is configured to actuate a cooler configured to remove energy from the emitter such that the emitter preferentially condenses at a first portion of the lamp.

35. The apparatus of claim 30, wherein the circuit is configured control the operation of the heater in response to an input.

36. The apparatus of claim 35, wherein the circuit is configured to control the operation of the heater in response to a profile of a time.

37. The apparatus of claim 35, wherein the circuit is configured to switch off the heater.

38. The apparatus of claim 37, wherein the circuit is configured to switch off the heater in response to a temperature of the lamp.

39. The apparatus of claim 37, wherein the circuit is configured to switch off the heater in response to an optical output of the lamp.

40. The apparatus of claim 39, wherein the optical output is a brightness at a first location.

41. The apparatus of claim 29, wherein the cooler reduces the temperature of the first portion of the lamp such that the emissive material preferentially condenses at the first portion of the lamp.

42. The apparatus of claim 29, wherein the circuit is configured to cause the cooler to reduce the temperature of the first portion via active cooling.

43. The apparatus of claim 42, wherein the circuit comprises an energy storage device coupled to the lamp.

44. An apparatus for operating a mercury-free low-pressure lamp including a bulb having: one or more phosphors configured to convert photons to visible or other visible wavelengths, an envelope filled with one or more gases at a pressure below 0.01 atmospheres, and at least one emissive material including at least one of an alkali metal and an alkaline earth metal, the lamp including at least one reservoir configured to receive the emissive material upon shutdown of the lamp, the apparatus comprising:

a heater configured to heat the emissive material in the reservoir;

a cooler configured to remove energy from the emitter; and a circuit configured to actuate the cooler such that the emitter preferentially condenses at a first portion of the lamp and, in response to a startup command, to cause the emissive material to vaporize into the envelope to form an emitter and to cause an excitation of the emitter with an electron such that the emitter in combination with the gases generate visible or ultraviolet photons.

* * * * *